US010862238B2

(12) United States Patent
Hasan

(10) Patent No.: US 10,862,238 B2
(45) Date of Patent: Dec. 8, 2020

(54) ELECTRICAL PLUG AND ADAPTER WITH RETRACTABLE PRONGS

(71) Applicant: CABLE GEAR HOLDINGS LLC, Katy, TX (US)

(72) Inventor: Faruq Syed Hasan, Ottawa (CA)

(73) Assignee: Cable Gear Holdings LLC, Katy, TX (US)

( * ) Notice: Subject to any disclaimer, the term of this patent is extended or adjusted under 35 U.S.C. 154(b) by 0 days.

(21) Appl. No.: 16/305,402

(22) PCT Filed: Mar. 9, 2018

(86) PCT No.: PCT/IB2018/051568
§ 371 (c)(1),
(2) Date: Nov. 29, 2018

(87) PCT Pub. No.: WO2018/167619
PCT Pub. Date: Sep. 20, 2018

(65) Prior Publication Data

US 2019/0288437 A1 Sep. 19, 2019

(30) Foreign Application Priority Data

Mar. 17, 2017 (CA) ..... 2961248

(51) Int. Cl.
*H01R 13/44* (2006.01)
*H01R 24/28* (2011.01)
(Continued)

(52) U.S. Cl.
CPC ..... *H01R 13/44* (2013.01); *H01R 13/502* (2013.01); *H01R 24/28* (2013.01); *H01R 27/00* (2013.01);
(Continued)

(58) Field of Classification Search
CPC ..... H01R 13/44; H01R 13/506; H01R 31/06; H01R 24/28; H01R 2103/00; H01R 27/00
See application file for complete search history.

(56) References Cited

U.S. PATENT DOCUMENTS 3,458,794 A * 7/1969 Bohnstedt ..... H01R 13/44 439/131
4,001,803 A * 1/1977 Lombardo ..... F21L 4/022 439/131
(Continued)

FOREIGN PATENT DOCUMENTS

CA 2961248 A1 6/2017

OTHER PUBLICATIONS

International Search Report in PCT/IB18/51568, dated Jul. 10, 2018.
(Continued)

*Primary Examiner* — Briggitte R. Hammond
(74) *Attorney, Agent, or Firm* — Kyma Professional Corporation

(57) ABSTRACT

An electrical plug or power adapter is described which includes a housing and a plurality of retractable prongs forming at least one retractable prong set. The prongs of each prong set are rotatable simultaneously between a retracted position in which the prongs are positioned within the housing and a deployed position in which the prongs extend out of the housing to be inserted into an electrical outlet. The electrical plug or adapter includes at least one gear-based driving mechanism coupled to a corresponding retractable prong set for driving the simultaneous rotation of the prongs of the prong set. The gear-based driving mechanism includes a driver accessible from the housing for actuation of the corresponding gear-based driving mechanism.

23 Claims, 31 Drawing Sheets

(51) Int. Cl.

| | |
|---|---|
| ***H01R 13/502*** | (2006.01) |
| ***H01R 31/06*** | (2006.01) |
| ***H01R 27/00*** | (2006.01) |
| ***H01R 103/00*** | (2006.01) |
| *H01R 24/30* | (2011.01) |

(52) U.S. Cl.
CPC ..... *H01R 31/06* (2013.01); *H01R 24/30* (2013.01); *H01R 2103/00* (2013.01)

(56) References Cited

U.S. PATENT DOCUMENTS

| | | | | |
|---|---|---|---|---|
| 4,743,829 | A * | 5/1988 | Fenne | H01R 24/68 439/131 |
| 4,997,381 | A * | 3/1991 | Oh | H01R 27/00 439/131 |
| 5,006,779 | A * | 4/1991 | Fenne | H01R 24/68 439/131 |
| 5,967,807 | A * | 10/1999 | Wu | H01R 29/00 439/131 |
| 6,126,460 | A * | 10/2000 | Wu | H01R 27/00 439/131 |
| 6,241,538 | B1 * | 6/2001 | Chen | H01R 13/71 439/131 |
| 6,923,666 | B1 * | 8/2005 | Liao | H01R 31/06 439/131 |
| 6,939,150 | B1 * | 9/2005 | Lanni | H01R 35/04 439/131 |
| 8,043,100 | B2 * | 10/2011 | Liao | H01R 31/06 439/131 |
| 8,096,817 | B2 | 1/2012 | Lee et al. | |
| 8,366,461 | B2 * | 2/2013 | Lee | H01R 24/30 439/131 |
| 8,388,361 | B2 | 3/2013 | Wavra et al. | |
| 8,469,730 | B2 | 6/2013 | Garb et al. | |
| 9,011,165 | B2 * | 4/2015 | Liu | H01R 31/065 439/131 |
| 9,024,581 | B2 * | 5/2015 | McGinley | H02J 7/0042 320/111 |
| 9,130,384 | B2 | 9/2015 | Pliner et al. | |
| 9,331,441 | B2 * | 5/2016 | Roy | H01R 13/434 |
| 2002/0160636 | A1 * | 10/2002 | Steiert | H01R 33/96 439/131 |
| 2006/0073717 | A1 * | 4/2006 | Ng | H01R 35/04 439/131 |
| 2009/0124104 | A1 * | 5/2009 | Zhu | G06K 19/07 439/131 |
| 2012/0015534 | A1 * | 1/2012 | Wavra | G06F 13/409 439/131 |
| 2014/0322938 | A1 * | 10/2014 | Tseng | H01R 13/44 439/131 |

OTHER PUBLICATIONS

Written Opinion in PCT/IB18/51568 , dated Jul. 10, 2018.
International Preliminary Report on Patentability in in PCT/IB18/51568, dated Sep. 17, 2019.
Office Action dated Jun. 30, 2017 for Canadian Patent Application No. 2,961,248 (Canada).

* cited by examiner (a)

ELECTRICAL PLUG AND ADAPTER WITH RETRACTABLE PRONGS

CROSS REFERENCE TO RELATED APPLICATIONS

This application claims the benefit of priority based on Canadian Application No. 2,961,248, filed on Mar. 17, 2017, entitled, "Electrical Plug and Adapter with Retractable Prongs", the disclosure of which is hereby incorporated by reference herein.

TECHNICAL FIELD

The present description relates generally to electrical plugs and adapters and, more particularly, to electrical plugs and adapters with retractable prongs.

BACKGROUND

Electrical plugs and power adapters are common portable appliances for enabling connections between electrically operated devices and standard alternating current (AC) power supplies. A typical electrical plug or adapter can include two or three prongs to be inserted in a compatible power socket employed in a residential or commercial building. The configuration and dimensions of the prongs used in a country are governed by national standards and regulations which can differ from country to country.

The trend towards more-compact electronic devices has driven a shift towards more compact and versatile plugs and adapters. Collapsible plugs and adapters have become favorable because the use of retractable prongs can allow for a reduction of the shipping size and a better protection of the prongs from damage when not in use. However, conventional collapsible plugs and adapters may require the prongs to be manipulated directly by hands, have significant part counts, and can be difficult to use.

There is a general desire for electrical plugs and adapters that can provide better usability and/or versatility, especially in an international context.

SUMMARY

The following presents a simplified summary of some aspects or embodiments of the invention in order to provide a basic understanding of the invention. This summary is not an extensive overview of the invention. It is not intended to identify key or critical elements of the invention or to delineate the scope of the invention. Its sole purpose is to present some embodiments of the invention in a simplified form as a prelude to the more detailed description that is presented later.

According to one aspect of the description, an electrical plug is described. The electrical plug comprises a housing; a retractable prong set including a plurality of prongs, the plurality of prongs being rotatable simultaneously between a retracted position in which the plurality of prongs are positioned within the housing and a deployed position in which the plurality of prongs extend out of the housing to be inserted into an electrical outlet; and a gear-based driving mechanism coupled to the retractable prong set for driving the plurality of prongs to simultaneously rotate between the retracted position and the deployed position. The gear-based driving mechanism includes a driver accessible from the housing for actuation of the gear-based driving mechanism.

According to another aspect of the description, the electrical plug comprises a housing; a first retractable prong set including a first plurality of prongs, the first plurality of prongs being rotatable simultaneously between a retracted position in which the first plurality of prongs are positioned within the housing and a deployed position in which the first plurality of prongs extend out of the housing to be inserted into a first electrical outlet; a second retractable prong set including a second plurality of prongs, the second plurality of prongs being movable simultaneously between a retracted position in which the second plurality of prongs are positioned within the housing and a deployed position in which the second plurality of prongs extend out of the housing to be inserted into a second electrical outlet; a first gear-based driving mechanism coupled to the first retractable prong set for driving the first plurality of prongs to simultaneously rotate between the retracted position and the deployed position, and a second gear-based driving mechanism coupled to the second retractable prong set for driving the second plurality of prongs to simultaneously move between the retracted position and the deployed position. The first gear-based driving mechanism includes a first driver accessible from the housing for actuation of the first gear-based driving mechanism and the second gear-based driving mechanism includes a second driver accessible from the housing for actuation of the second gear-based driving mechanism.

According to another aspect of the description, the electrical plug comprises a housing; a plurality of retractable prong sets, each retractable prong set including a plurality of prongs rotatable simultaneously between a retracted position in which the corresponding prongs are positioned within the housing and a deployed position in which the corresponding prongs extend out of the housing to be inserted into an electrical outlet; and a plurality of gear-based driving mechanisms corresponding to the plurality of retractable prong sets, each gear-based driving mechanism coupled to the corresponding retractable prong set for driving the plurality of prongs of the corresponding retractable prong set simultaneously between the retracted position and the deployed position. Each gear-based driving mechanism includes a driver accessible from the housing for actuation of the corresponding gear-based driving mechanism.

According to another aspect of the description, a power adapter is described. The power adapter comprises a housing; a retractable prong set including a plurality of prongs, the plurality of prongs being rotatable simultaneously between a retracted position in which the plurality of prongs are positioned within the housing and a deployed position in which the plurality of prongs extend out of the housing to be inserted into an electrical outlet; and a gear-based driving mechanism coupled to the retractable prong set for driving the plurality of prongs to simultaneously rotate between the retracted position and the deployed position. The gear-based driving mechanism includes a driver accessible from the housing for actuation of the gear-based driving mechanism. The power adapter can further comprise a plurality of receptacles for receiving compatible external prongs.

BRIEF DESCRIPTION OF THE DRAWINGS

These and other features of the disclosure will become more apparent from the description in which reference is made to the following appended drawings.

FIG. 26 is a perspective view of the internal structure of the electrical plug shown in

FIG. 23;

DETAILED DESCRIPTION

Figure 1:
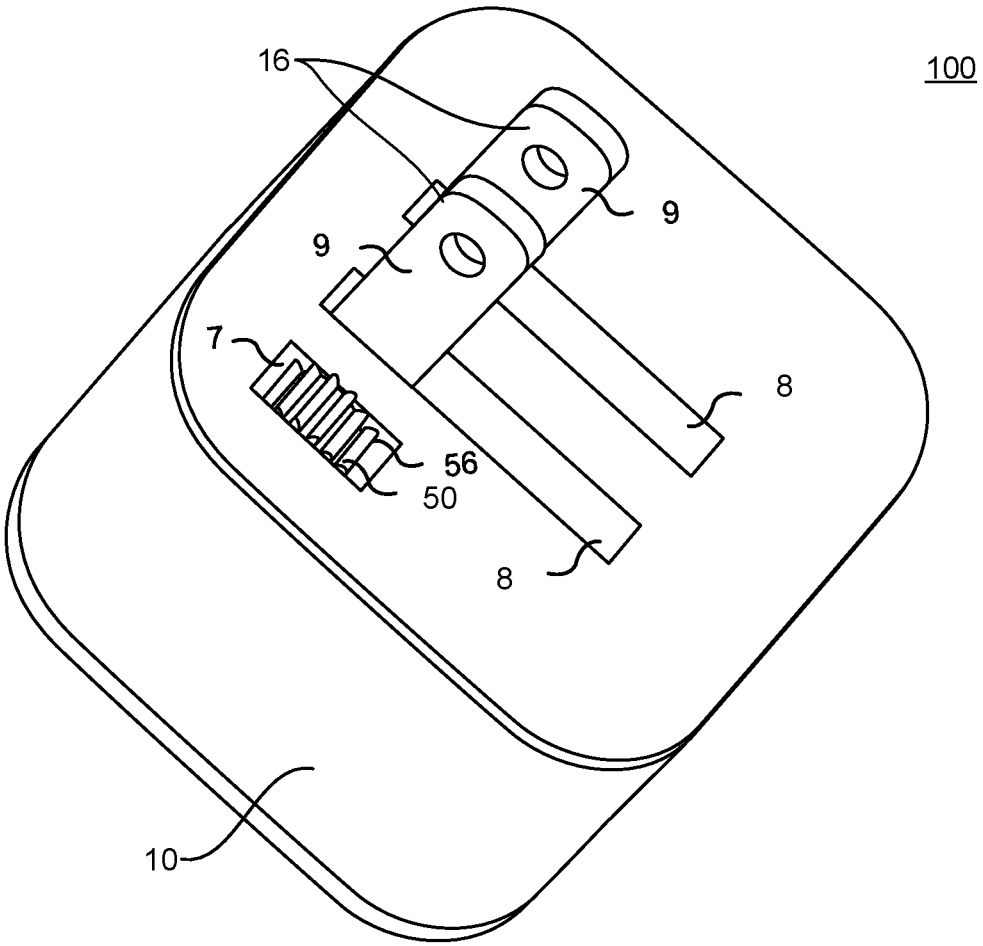
FIG. 1 is a perspective view of an electrical plug according to a first embodiment of the description, showing a single prong set in a deployed position.

The following detailed description contains, for the purposes of explanation, numerous specific embodiments, implementations, examples and details in order to provide a thorough understanding of the invention. It is apparent, however, that the embodiments may be practiced without these specific details or with an equivalent arrangement. In other instances, some well-known structures and devices may be omitted in order to avoid unnecessarily obscuring the illustration of the embodiments. It should be understood that the following descriptions are not intended to limit the embodiments only to the described implementations and techniques, or the illustrated exemplary designs and implementations. To the contrary, it is intended to cover alternatives, modifications, and equivalents as can be included within the scope of the described embodiments.

Various embodiments of present description relate to electrical plugs and power adapters, and more particularly, to electrical plugs and power adapters with retractable prongs.

An electrical plug or power adapter is used for connecting an electrically operated device to an electrical outlet or receptacle in a residential or commercial building. An electrical plug typically includes two or three prongs working as a unit (referred to as a prong set) to be inserted in a compatible power socket for power connection. The two or three prongs are typically shaped and configured according to national standards and regulations. For purposes of illustration, the following description will make reference to prong sets compatible with particular IEC standard types, including the IEC Standard Type G used in the United Kingdom (UK) (referred to as a Type G prong set), IEC Standard Type A used in the United States (US) (referred to as a Type A prong set), and IEC Standard Types C/E used in the European Union (EU) (referred to as a Type E/C prong set). The Type A and Type C/E prong sets each has two prongs, whilst the Type G prong set has three prongs. It should be understood that while prong sets of particular types are used for demonstration of the embodiments, the electrical plugs of the present description are not intended to limit only to the prong sets as described or illustrated, but can be applied to other prong sets with prongs of different numbers, shapes and/or dimensions.

As will be described in more detail below, an electrical plug or power adapter according to the embodiments of the description includes a housing and a plurality of retractable prongs forming at least one retractable prong set. The prongs of each prong set are rotatable simultaneously between a retracted position in which the prongs are positioned within the housing and a deployed position in which the prongs extend out of the housing to be inserted into an electrical outlet. The electrical plug or power adapter further includes at least one gear-based driving mechanism coupled to a corresponding retractable prong set for driving the simultaneous rotation of the prongs of the prong set. The gear-based driving mechanism includes a driver which can be accessed from the housing for actuation of the gear-based driving mechanism. The driver can take the form of a driver gear, disc, or other wheel-like part that when rotated or otherwise manipulated by the user transfers motion to other parts of the gear-based driving mechanism By manipulating the driver, the user can retract and deploy the corresponding prong set without any direct contact with the prongs. Each gear-based driving mechanism can include a gear or a series of gears. Various types of gears can be employed for the purpose of the description, including but not limited to spur, bevel, sprocket and spiral gears.

According to the embodiments of the description, the driver can be arranged to be accessible from a same or different side of the housing from which the corresponding prongs extend out of. In some embodiments, the electrical plug or power adapter includes a single retractable prong set. In other embodiments, the electrical plug or power adapter includes multiple retractable prong sets, each being driven by a corresponding driver to move between the retracted position and the deployed position. The multiple retractable prong sets can be arranged to be deployable from the same side of the housing, or from different sides of the housing. Various mating mechanisms are configured to allow for an effective electrical connection for the prongs, including using busbars and/or prongs with modified bases. When the prong set comes into the deployed position, the mating mechanism allows for an effective connection for the prongs. As the prong set moves from the deployed position to the retracted position, the prongs of the prong set become disconnected electrically to ensure safety. While various embodiments show electrical plugs, or power plugs, it is understood that the described structure can also apply to electrical adapters, or power adapters. In the case of an adapter, one side of the housing can include a plurality of receptacles for receiving compatible external prongs.

Referring to FIG. 1, an electrical plug 100 is shown according to a first embodiment of the description. The electrical plug 100 includes a housing 10 for accommodating a retractable Type A prong set 16. The Type A prong set 16 includes two generally rectangular prongs 9 configured according to the IEC Type A standard used in the US. The two prongs 9 can be rotated simultaneously as a unit between a retracted position in which the prongs 9 are stowed within neutral slots 8 of the housing 10 and a deployed position in which the prongs 9 extend out of the neutral slots 8 of the housing 10. In FIG. 1, the prong set 16 is shown in the deployed position and can be readily inserted into an external electrical outlet or receptacle (not shown). The simultaneous rotation of the prongs 9 of the prong set 16 can be driven by manipulating a driver 56 accessible through a slot 7 of the housing 10. In this particular embodiment, the driver 56 is a spur gear 50 arranged to be accessible through a same side of the housing 10 as the neutral slots 8 from which the prongs 9 extend out of.

Figure 2:
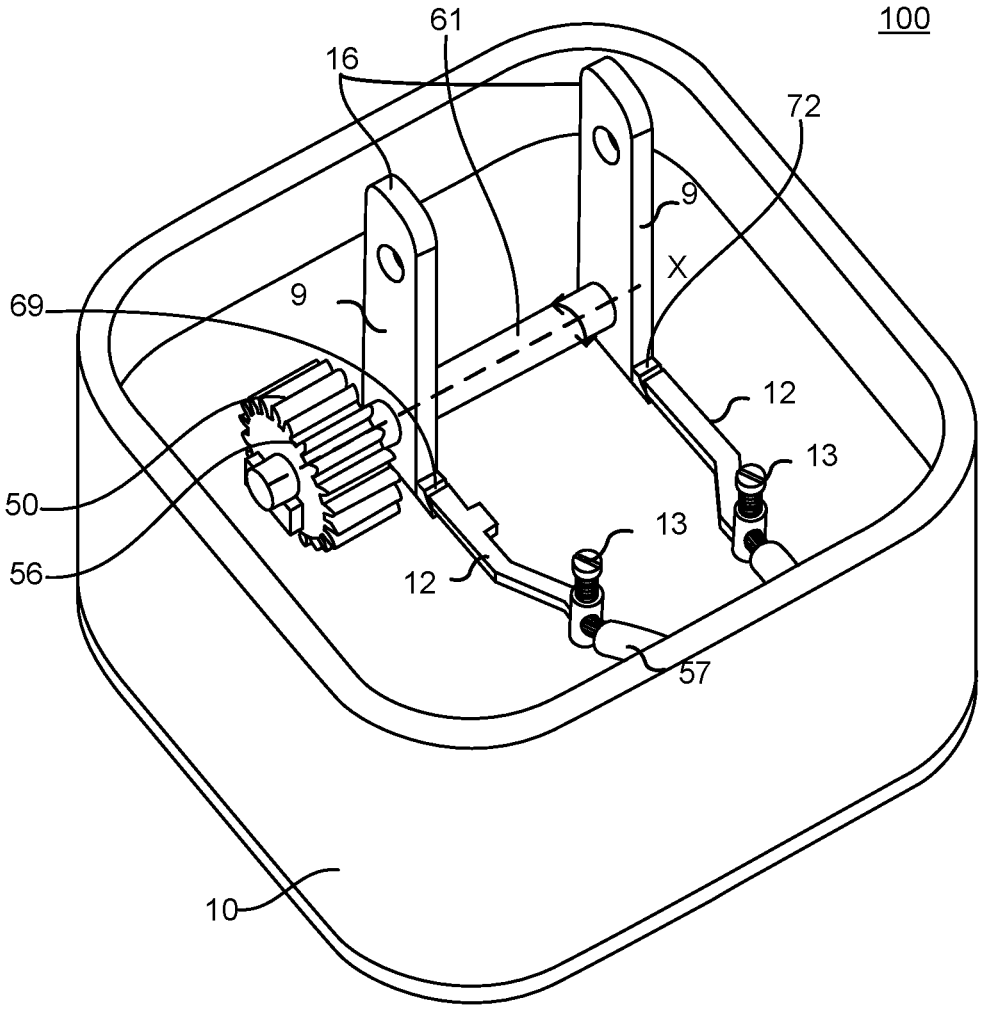
FIG. 2 is a perspective view of the electrical plug shown in FIG. 1, with a portion of the housing removed to show an internal structure of the electrical plug.

FIG. 2 illustrates an internal structure of the electrical plug 100 shown in FIG. 1. As shown in FIG. 2, the prongs 9 of the prong set 16 are mounted to a shaft 61. The spur gear 50 is coupled to the shaft 61 and can be rotatable with respect to a same axis X as the shaft 61. To retract or deploy the prong set 16, a user can rotate the spur gear 50 with respect to the axis X which in turn rotates the shaft 61 and simultaneously rotates the prongs 9 mounted to the shaft 61 with respect to the same axis X.

The prongs 9 are connected to the external power source through busbars 12 and cable barrels 13 fixed to the busbars 12. The cable barrels 13 can facilitate connection 57 by means of wires. As will be described in more detail below, the base of the prong 9 can include a tapered surface 72 for an improved mating mechanism 69 with the busbar 12. When the prong set 16 comes into the deployed position, the improved mating mechanism 69 allows for an effective connection for the prongs 9. When the prong set 16 moves from the deployed position to the retracted position, the prongs 9 of the prong set 16 become disconnected from the busbars 12 cutting any electricity supply.

Figure 3:
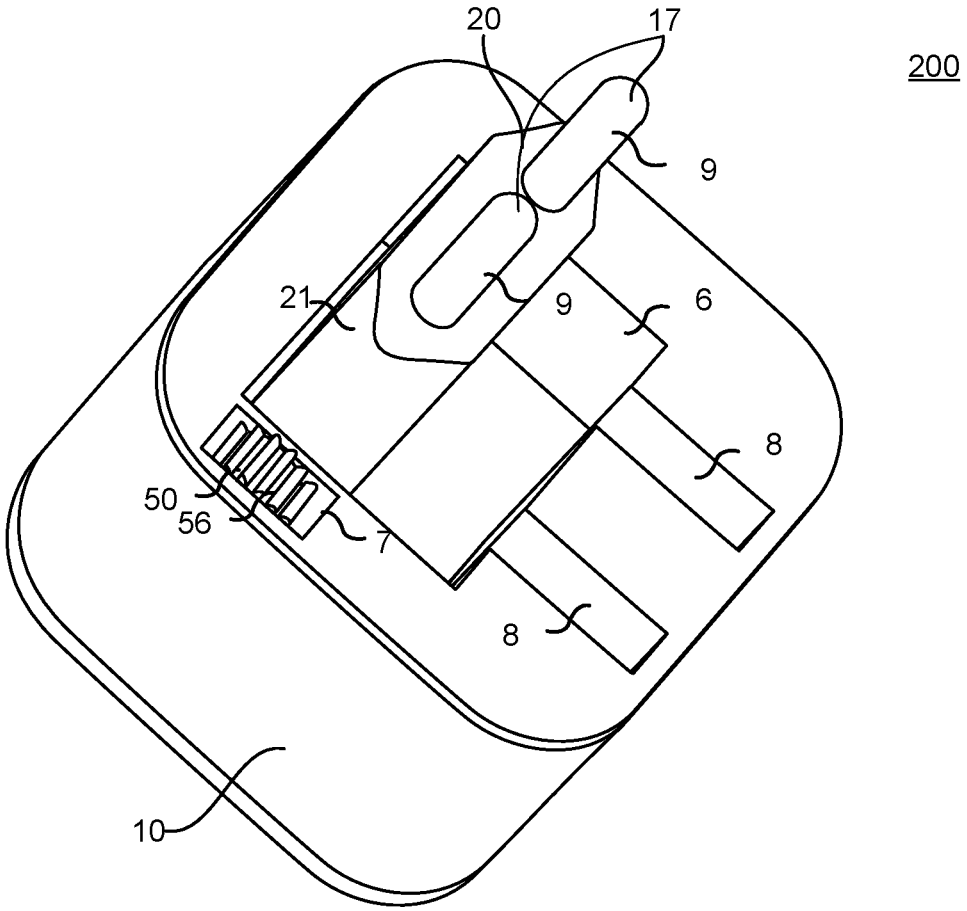
FIG. 3 is a perspective view of an electrical plug according to a second embodiment of the description, showing a single prong set in a deployed position.

FIG. 3 illustrates an electrical plug 200 according to a second embodiment of the description. In this embodiment, the electrical plug 200 includes a retractable Type C prong set 17. The Type C prong set 17 includes two round prongs 9 configured according to the IEC Type C standard used in the EU and is mounted as part of a prong assembly 20 housing an insulated shaft 21. The two prongs 9 can be rotated simultaneously as a unit between a retracted position in which the prongs 9 are stowed within neutral slots 6, 8 of the housing 10 and a deployed position in which the prongs 9 extend out of the neutral slots 6, 8 of the housing 10. It should be understood that the neutral slots 6, 8 are dimensioned to stow the insulated shaft 21 and the prongs 9, respectively. The simultaneous rotation of the prongs 9 of the prong set 17 can be driven by manipulation of a driver 56 accessible from the housing 10. In this particular embodiment, the driver 56 can be a spur gear 50 arranged to be accessible through a slot 7 on a same side of the housing 10 as the neutral slots 6, 8 from which the prongs 9 extend out of.

Figure 4:
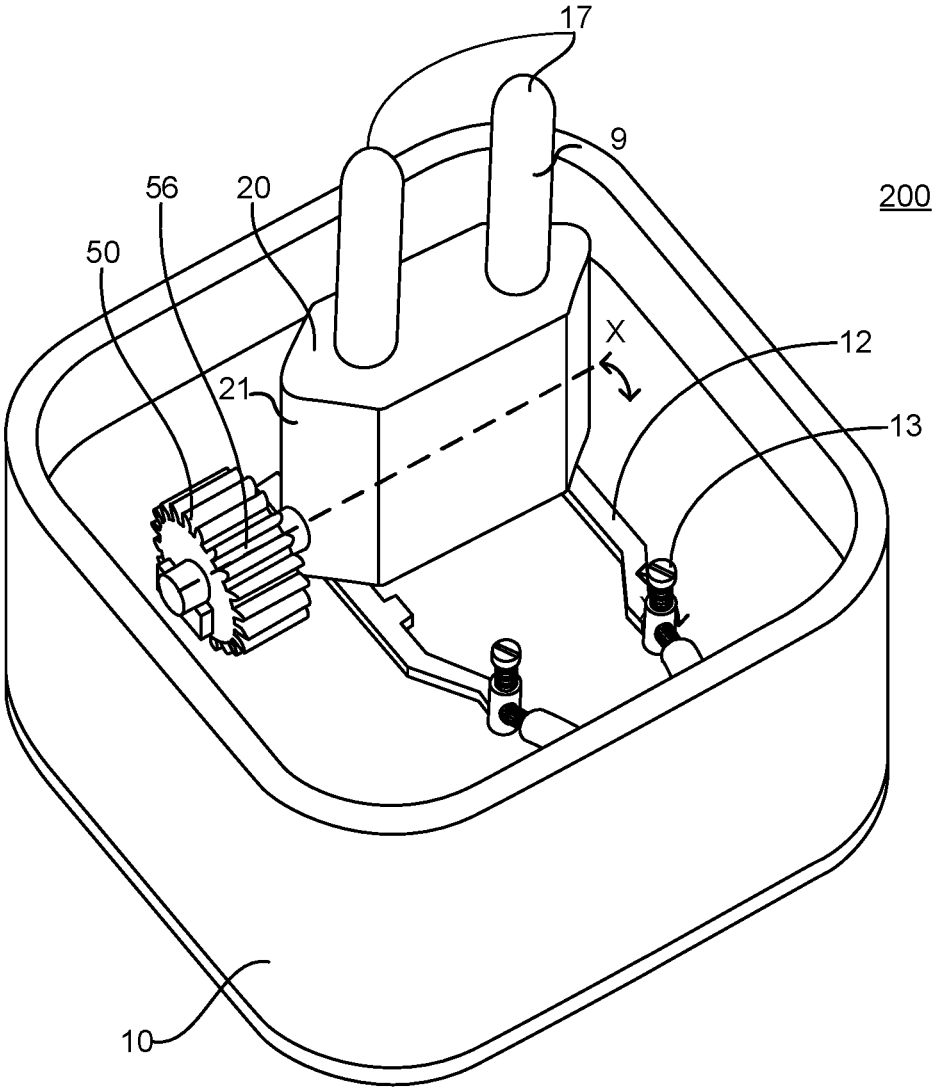
FIG. 4 is a perspective view of the electrical plug shown in FIG. 3, with a portion of the housing removed to show an internal structure of the electrical plug.

FIG. 4 illustrates an internal structure of the electrical plug 200 shown in FIG. 3. Different from the first embodiment, the prongs 9 of the prong set 17 are mounted as part of the prong assembly 20, which is a mechanism for housing one or more prongs for simultaneous rotation. Using prong assemblies for mounting of the prongs can be advantageous in that additional features, such as latching mechanisms, RFID, magnets, and/or switches, can be easily added to the prong assemblies without the need for additional driving arrangements.

As shown in FIG. 4, the driver 56 is coupled to the prong assembly 20 and can be rotatable with respect to the same axis X as the prong assembly 20. To retract or deploy the prong set 17, a user can rotate the driver 56 with respect to the axis X which in turn rotates the prong assembly 20 and simultaneously rotates the prongs 9 mounted on the prong assembly 20 with respect to the same axis X.

According to the above described embodiments, one single gear is employed to achieve the simultaneous retraction and deployment of the prongs in a prong set. As will become apparent from the following description, a series of gears can be employed for driving of the prongs of a prong set simultaneously. According to the first and second embodiments, the driver 56 is arranged axially parallel to the rotation axis X of the prong set 16, 17. According to other embodiments of the description, it may be desirable to rotate the prongs from a driver that is arranged axially perpendicular to the rotation axis of the prong set.

Figure 5:
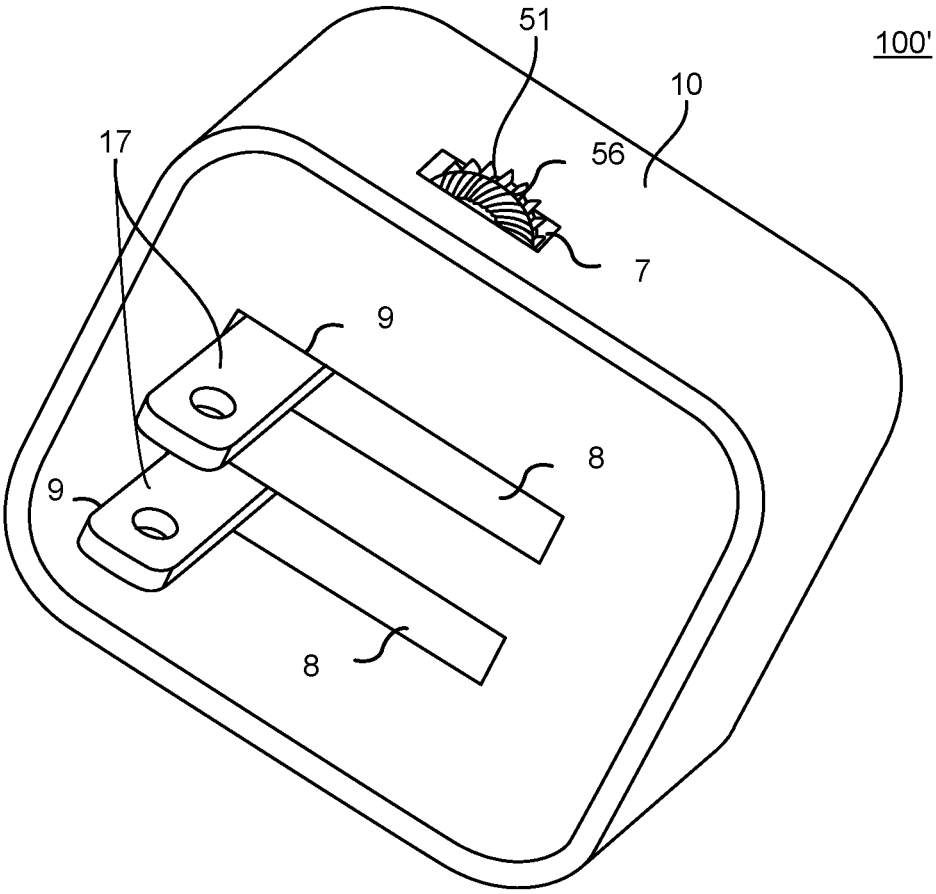
FIG. 5 is a perspective view of an electrical plug according to a third embodiment of the description, showing a driver gear on the side of the housing.

FIG. 5 illustrates an electrical plug 100' according to a third embodiment of the description. Similar to the first embodiment, the prong set 16 includes two generally rectangular prongs 9 configured according to the IEC Type A standard. However, instead of providing an access of the driver 56 on the same side of the housing 10 from which the prongs 9 extend out of, the driver 56 according to this embodiment is arranged on a different side of the housing 10, as shown in FIG. 5. In this embodiment, the driver 56 is a bevel gear 51, axially disposed perpendicular to the rotation axis of the prong set 16.

Figure 6:
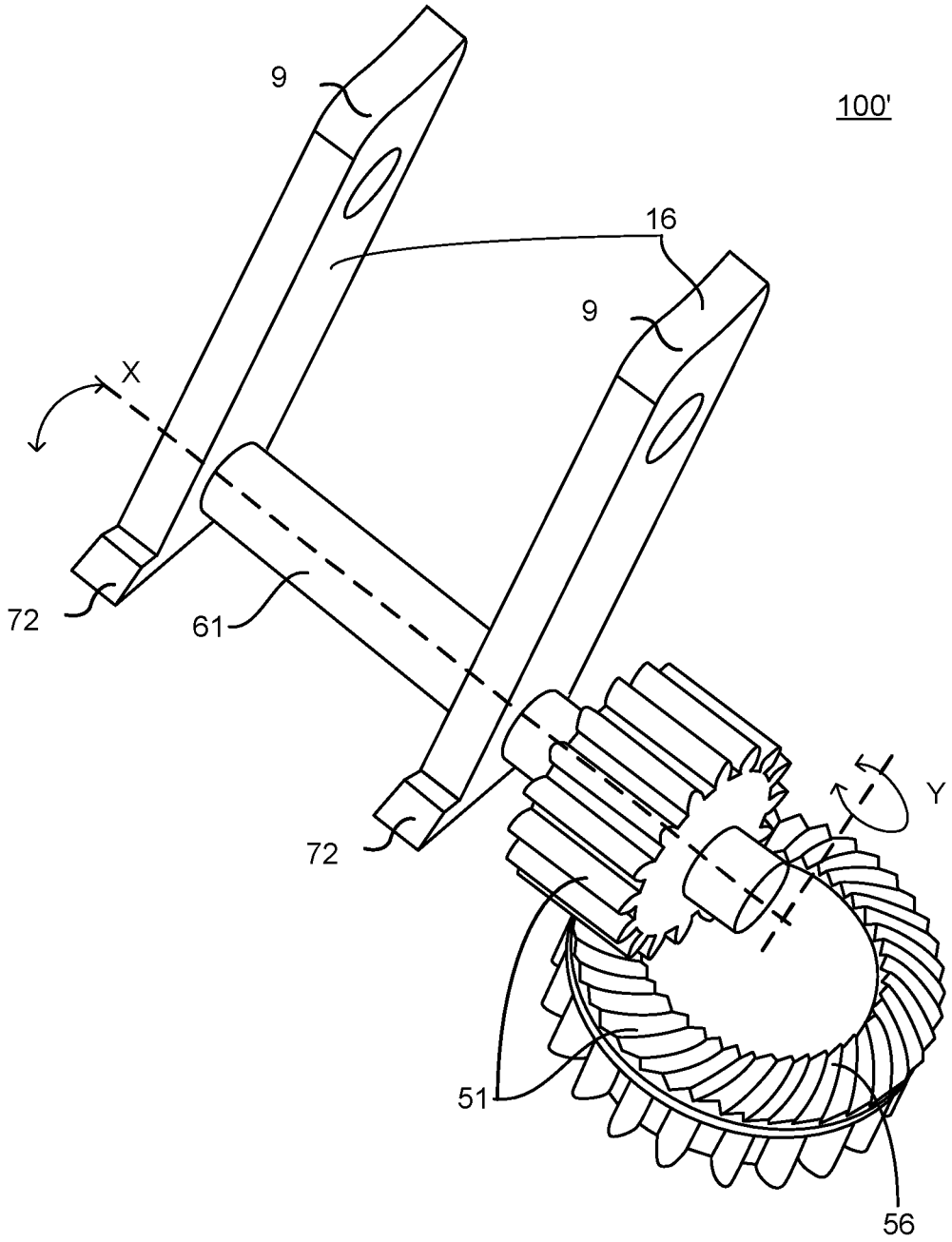
FIG. 6 is a perspective view of an internal structure of the electrical plug shown in FIG. 5.

FIG. 6 illustrates an internal structure of the electrical plug 100' shown in FIG. 5. As shown in FIG. 6, the prongs 9 of the prong set 16 are mounted to a shaft 61. The bevel gear 56 can be acted upon by the user to rotate with respect to an axis Y perpendicular to the rotation axis X of the prong set 16. To retract or deploy the prong set 16, a user can rotate the bevel gear 51 with respect to the axis Y which in turn rotates the shaft 61 with respect to the axis X and simultaneously rotates the prongs 9 mounted to the shaft 61.

Figure 7:
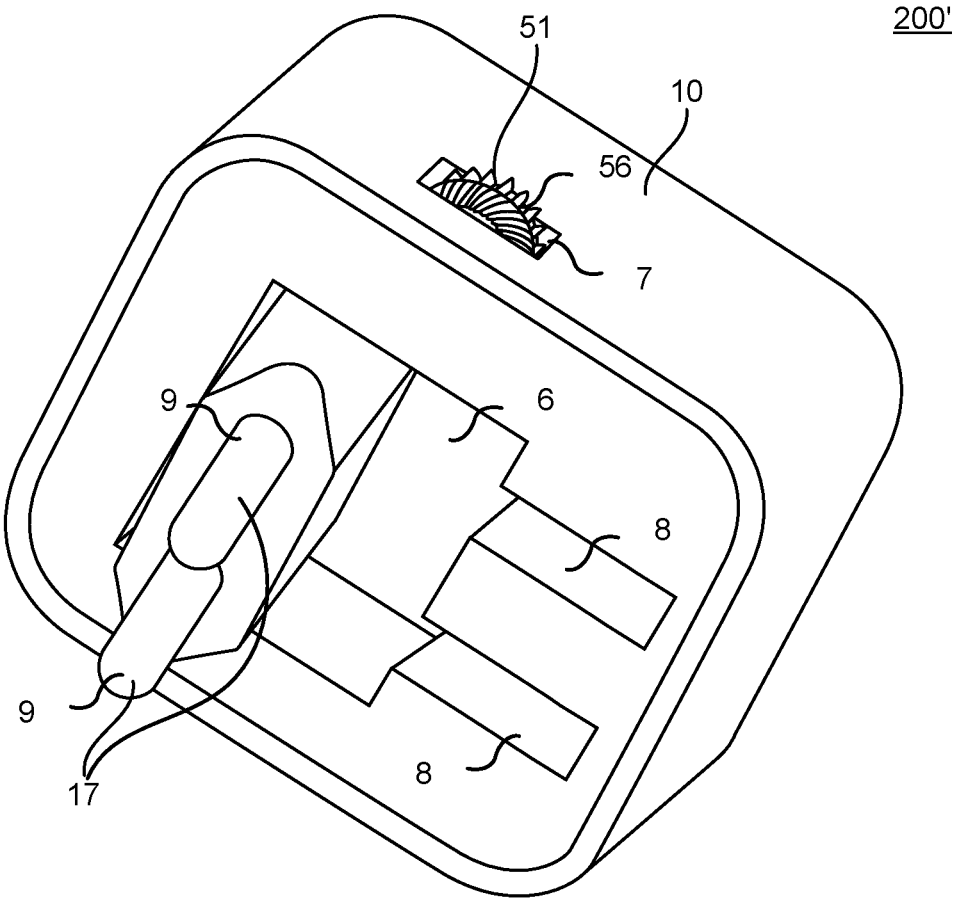
FIG. 7 is a perspective view of an electrical plug according to a fourth embodiment of the description, showing a driver gear on the side of the housing.

FIG. 7 illustrates an electrical plug 200' according to a fourth embodiment of the description. Similar to the second embodiment, the prong set 17 includes two round prongs 9 configured according to the IEC Type C standard. However, instead of providing an access of the driver 56 on the same side of the housing 10 from which the prongs 9 extend out of, the driver 56 according to this embodiment is arranged on a different side of the housing 10, as shown in FIG. 7. Similar to the third embodiment, the driver 56 is a bevel gear 51, axially disposed perpendicular to the rotation axis of the prong set 17.

Figure 8:
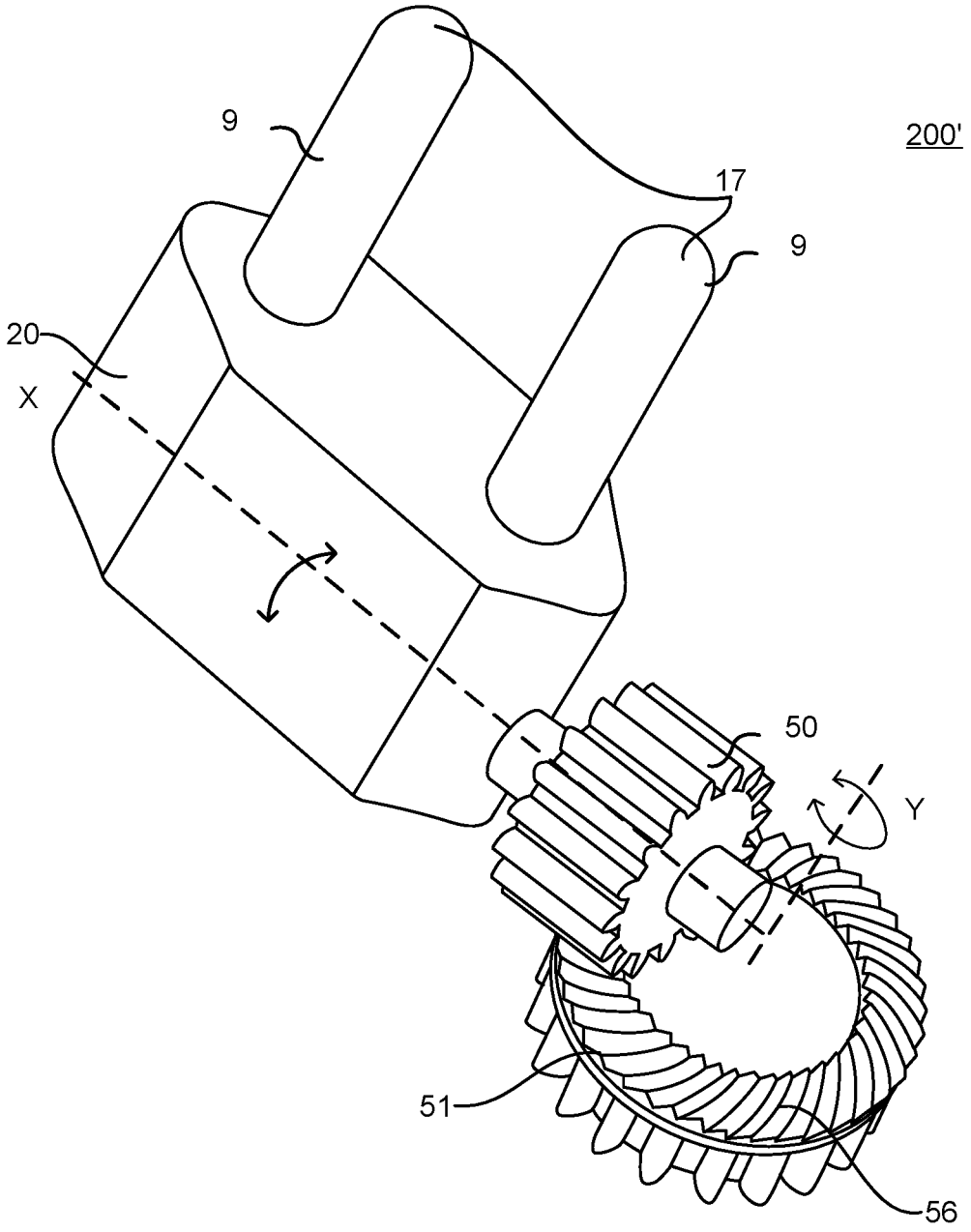
FIG. 8 is a perspective view of an internal structure of the electrical plug shown in FIG. 7.

FIG. 8 illustrates an internal structure of the electrical plug 200' shown in FIG. 7. As shown in FIG. 8, the prongs 9 of the prong set 17 are mounted as part of a prong assembly 20. The driver 56 can acted upon by the user to rotate around an axis Y perpendicular to the rotation axis X of the prong set 17. To retract or deploy the prong set 17, the user can rotate the bevel gear 51 with respect to the axis Y which in turn rotates the prong assembly 20 with respect to the axis X and simultaneously rotates the prongs 9 mounted as part of the prong assembly 20.

Figure 9:
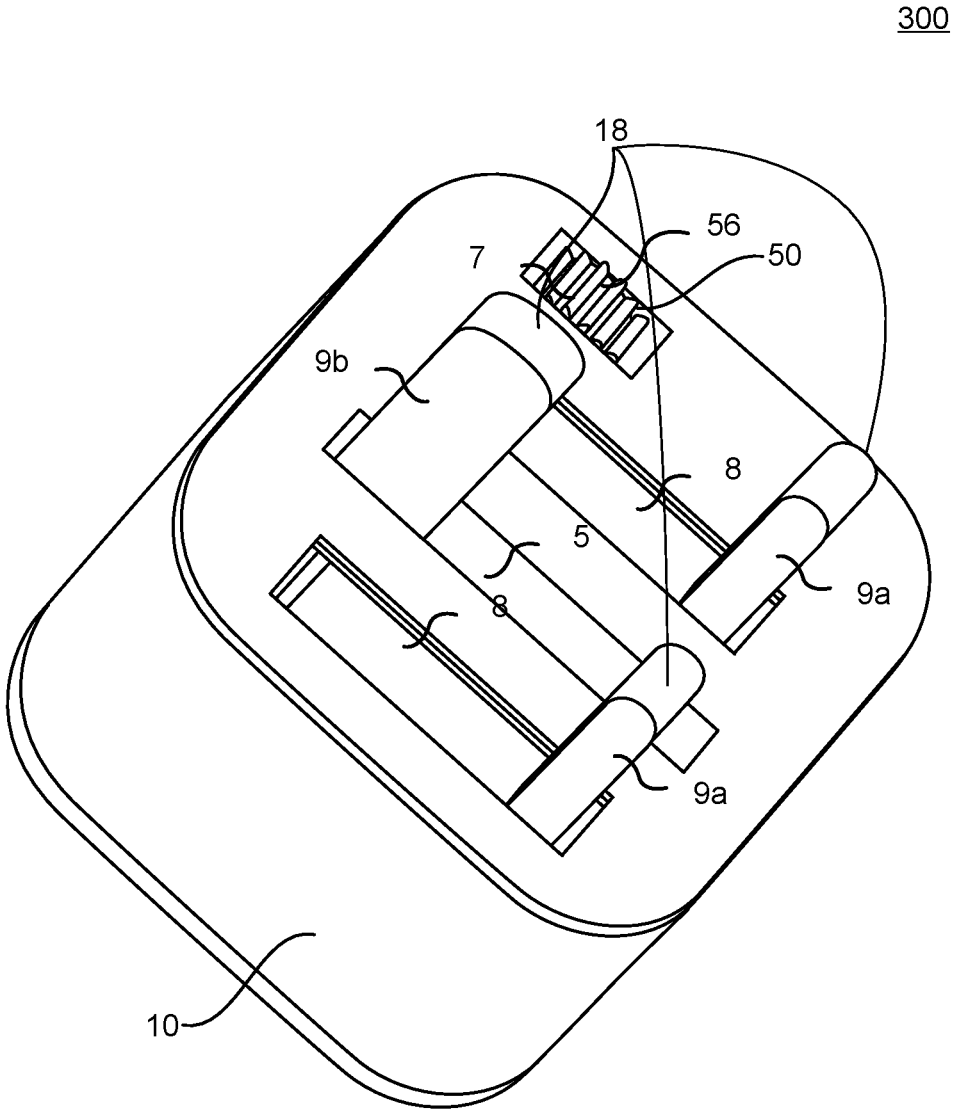
FIG. 9 is a perspective view of an electrical plug according to a fifth embodiment of the description, showing a single prong set in a deployed position.

Referring to FIG. 9, an electrical plug 300 is shown according to a fifth embodiment of the description. In this embodiment the electrical plug 300 includes a retractable Type G prong set 18. The Type G prong set 18 includes two line and neutral prongs 9*a* and one earth prong 9*b* forming an isosceles triangle, the prongs 9*a*, 9*b* being configured according to the IEC Type G standard used in the UK. An earth slot 5 and line and neutral slots 8 are dimensioned to stow the earth prong 9*b* and line and neutral prongs 9*a*, respectively. The three prongs 9*a*, 9*b* can be rotated simultaneously as a unit between a retracted position in which the prongs 9*a*, 9*b* are stowed within the slots 5, 8 of the housing 10 and a deployed position in which the prongs 9*a*, 9*b* extend out of the slots 5, 8 of the housing 10. The simultaneous rotation of the prong set 18 can be driven by manipulation of a driver 56 through a slot 7 of the housing 10. In this particular embodiment, the driver 56 is a spur gear 50 and arranged to be accessible through a same side of the housing 10 as the slots 5, 8 from which the prongs 9*a*, 9*b* extend out of.

Figure 10:
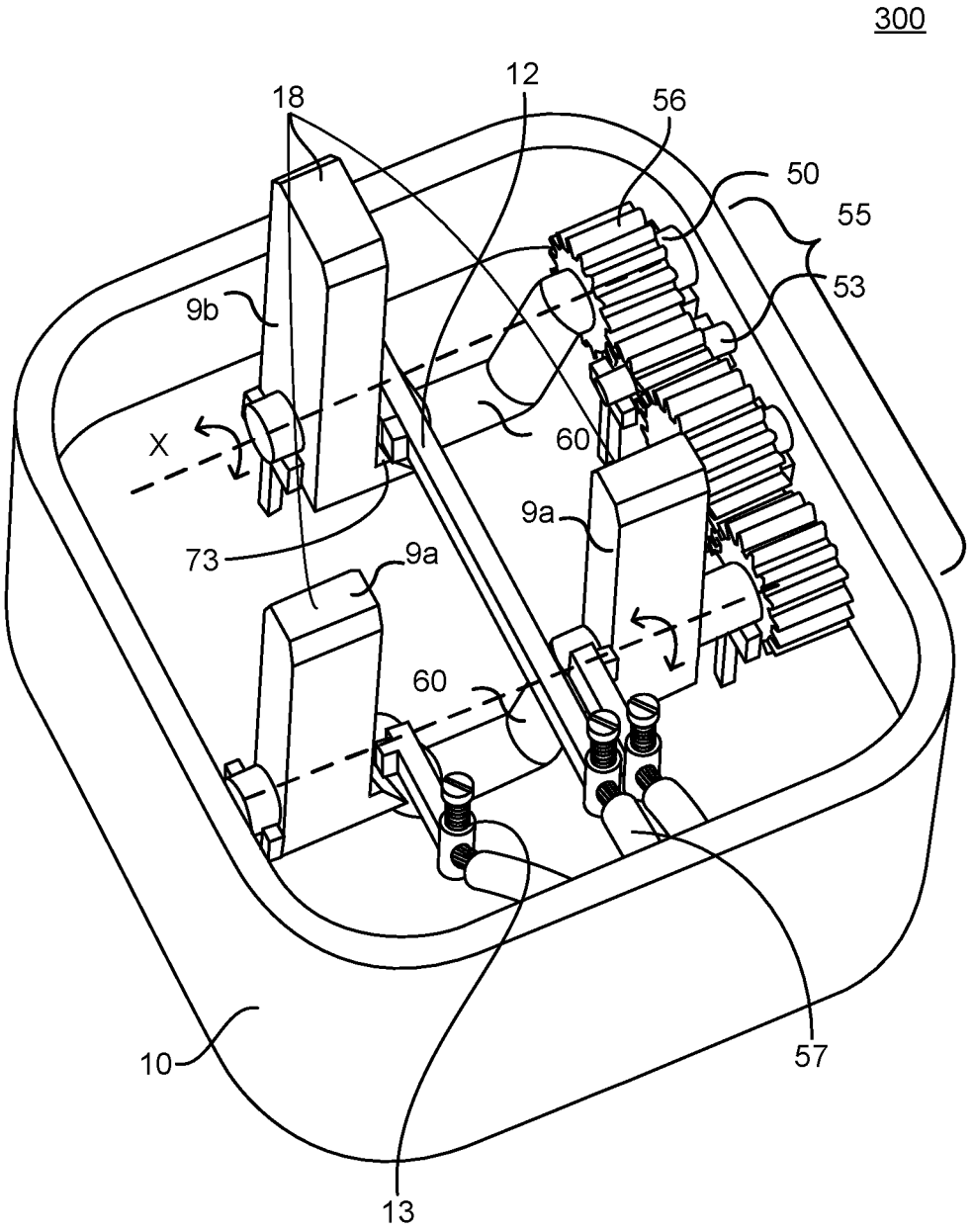
FIG. 10 is a perspective view of the electrical plug shown in FIG. 9, with a portion of the housing removed to show an internal structure of the electrical plug.

FIG. 10 illustrates an internal structure of the electrical plug 300 shown in FIG. 9. As shown in FIG. 10, the prongs 9*a*, 9*b* of the prong set 18 are mounted to two elbow shafts 60 which are axially parallel to each other. The two elbow shafts 60 are coupled to a series of gears, which are collectively referred to as a gear drivetrain 55. The gear drivetrain 55 can operate to rotate the two elbow shafts 60 simultaneously. As shown in FIG. 9, the gear drivetrain 55 includes a sprocket gear 53 for reversing the rotation direction of the driver 56 with respect to the balance of the gear drivetrain 55. This way, through manipulation of the driver 56 around the rotation axis X of the prong set 18, the two elbow shafts 60 can be rotated simultaneously in opposite directions, thereby folding or unfolding the prongs 9*a*, 9*b* mounted to the elbow shafts 60 simultaneously towards or away from the center of the housing 10.

The prongs 9*a*, 9*b* are connected to an external power source (not shown) through busbars 12 and cable barrels 13 fixed to the busbars 12. The cable barrels 13 can facilitate connection 57 by means of wires. As will be described in more detail below, the bottom of the prong 9*a*, 9*b* can have a modified prong side 73 for a side mating mechanism with the busbar 12. When the prong set 18 comes into the deployed position, the side mating mechanism allows for an effective connection for the prongs 9*a*, 9*b*. When the prong set 18 moves from the deployed position to the retracted position, the prongs 9*a*, 9*b* of the prong set 18 become disconnected from the busbars 12 cutting any electricity supply.

Figure 11:
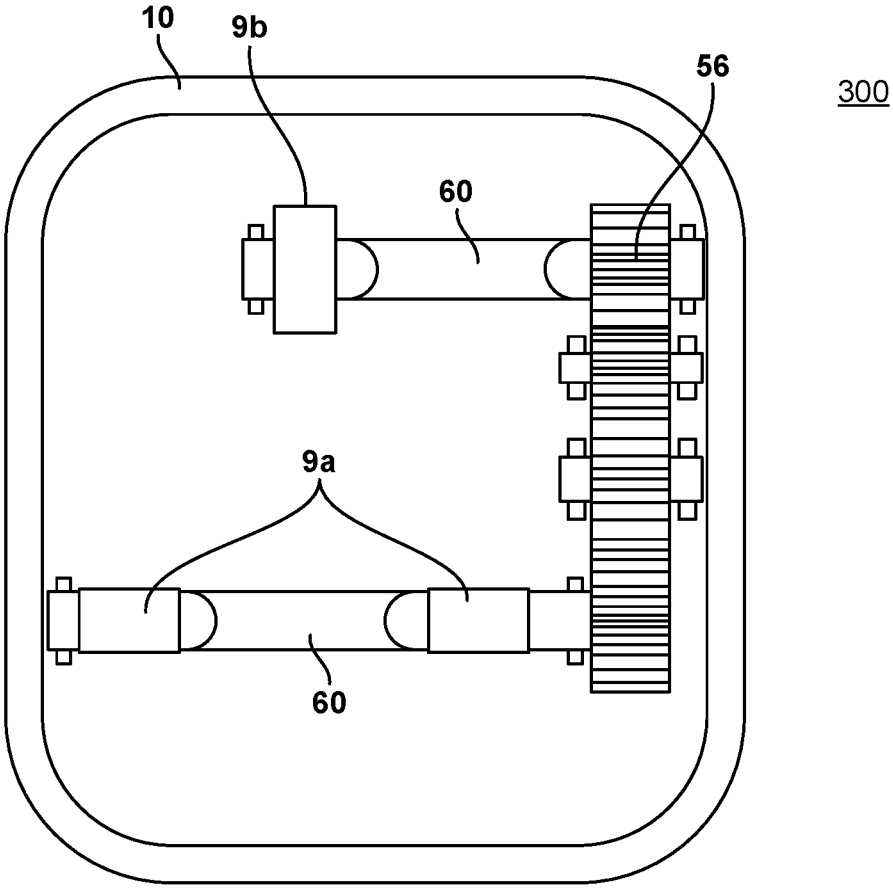
FIG. 11 is a top plan view of the electrical plug shown in FIG. 9 in the deployed position.
Figure 12:
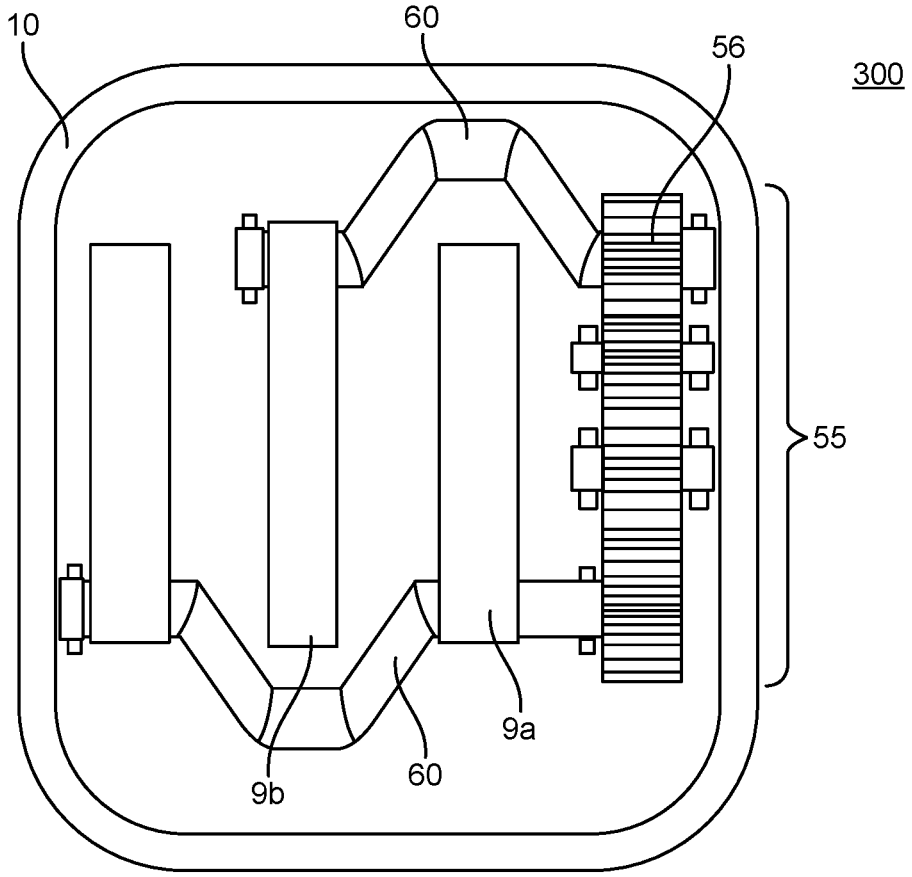
FIG. 12 is a top plan view of the electrical plug shown in FIG. 9 in a retracted position.

As shown in the FIG. 10, the electrical plug 300 employs elbow shafts 60 to couple the prongs 9*a*, 9*b* to the gear drivetrain 55. FIG. 11 is a top plan view of the electrical plug 300 in the deployed position; and FIG. 12 is a top plan view of the electrical plug 300 in the retracted position. As illustrated in FIG. 12, when the prongs 9*a*, 9*b* are in the retracted position, the use of elbow shafts 60 enables the prongs 9*a*, 9*b* to be stowed without contacting the shafts 60.

According to the IEC Type G standard, the earth prong 9*b* is longer than the horizontal distance between the earth prong 9*b* and the line and neutral prongs 9*a*. Accordingly it would be difficult to use straight shafts to mount the prongs 9*a*, 9*b* because when the prongs 9*a*, 9*b* are in the retracted position, the earth prong 9*b* would come into contact with a straight shaft. The use of elbow shaped shafts 60 avoids this issue and allows for easy deployment and retraction of the prongs without interfering other parts of the plug.

Figure 13:
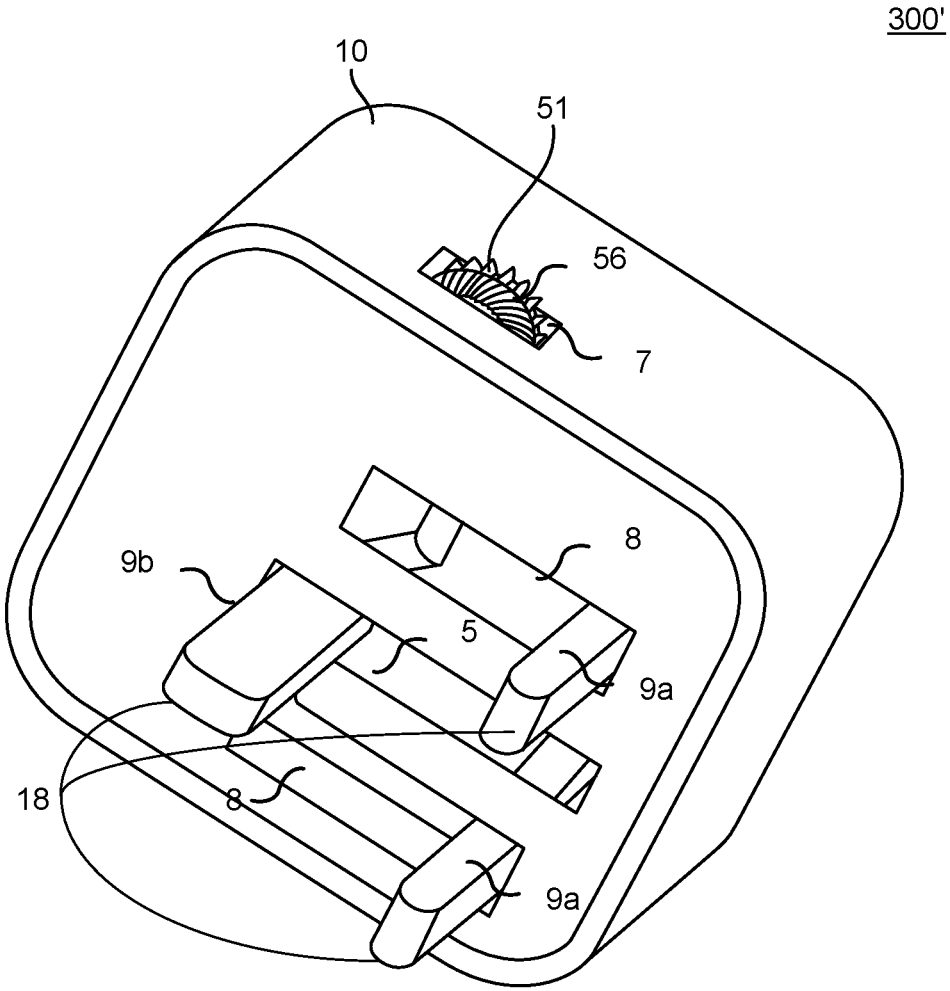
FIG. 13 is a perspective view of an electrical plug according to a sixth embodiment of the description, showing a driver gear on the side of the housing.

FIG. 13 illustrates an electrical plug 300' according to a sixth embodiment of the description. Similar to the fifth embodiment, the electrical plug 300' includes prongs 9*a*, 9*b* configured according to the IEC Type G standard. However, instead of providing an access of the driver 56 on the same side of the housing 10 from which the prongs 9*a*, 9*b* extend out of, the driver 56 according to this embodiment is arranged on a different side of the housing 10, as shown in FIG. 13. Similar to the third and fourth embodiments, the driver 56 is a bevel gear 51, axially disposed perpendicular to the rotation axis of the prong set 16.

Figure 14:
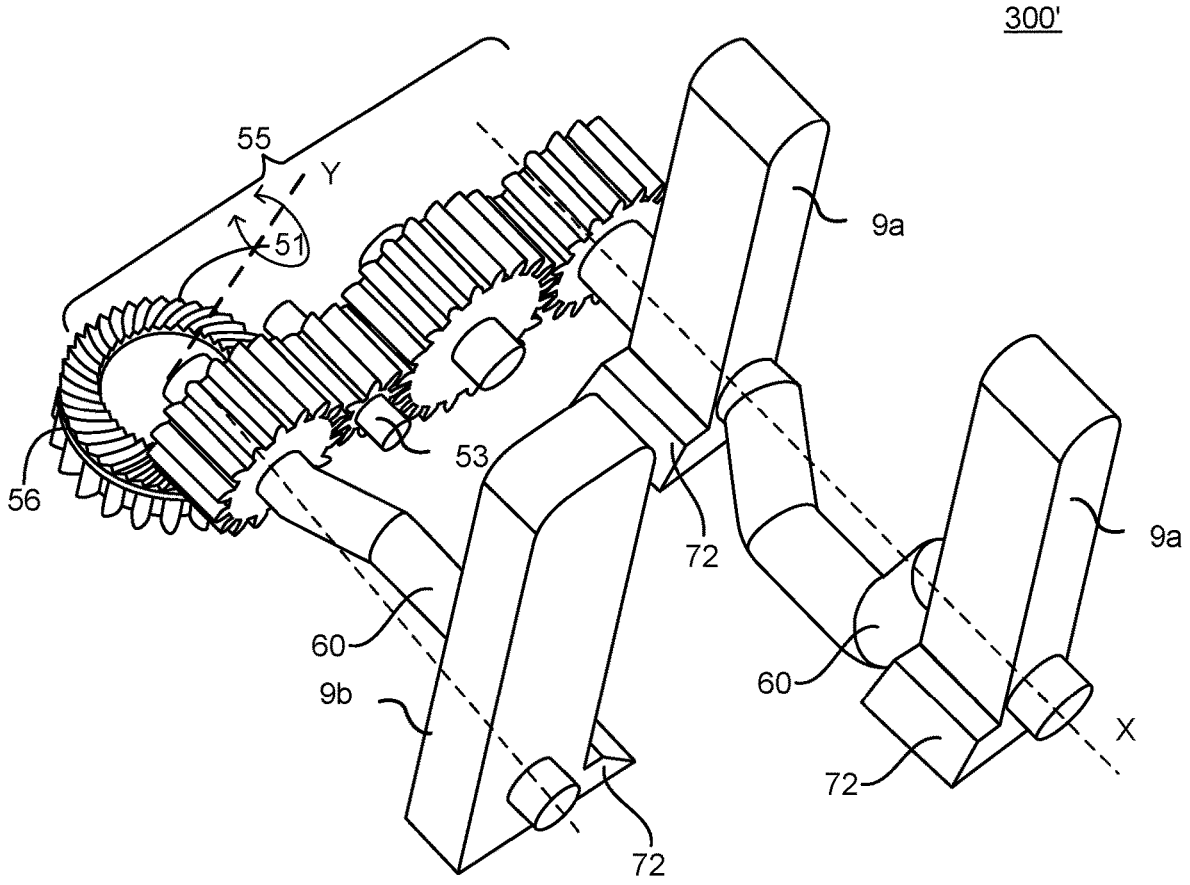
FIG. 14 is a perspective view of an internal structure of the electrical plug shown in FIG. 13.

FIG. 14 illustrates an internal structure of the electrical plug 300' shown in FIG. 13. As shown in FIG. 14 and similar to the fifth embodiment, the prongs 9*a*, 9*b* of the prong set 18 are mounted to two elbow shafts 60 which are axially parallel to each other. The two elbow shafts 60 are coupled to the gear drivetrain 55. The bevel gear 51 can be acted upon to rotate around the Y axis which drives the gears in the drivetrain 55 to rotate around the X axis. With the two elbow shafts 60 rotating simultaneously in opposite directions, the prongs 9*a*, 9*b* mounted to the elbow shafts 60 can be folded and unfolded at the same time towards or away from the center of the housing 10.

By way of the gear-based driving mechanism, the electrical plug according to the present description can accommodate not only a single retractable prong set, but also multiple retractable prong sets. Each prong set can be driven by a corresponding driver to move between the retracted position and the deployed position.

Figure 15:
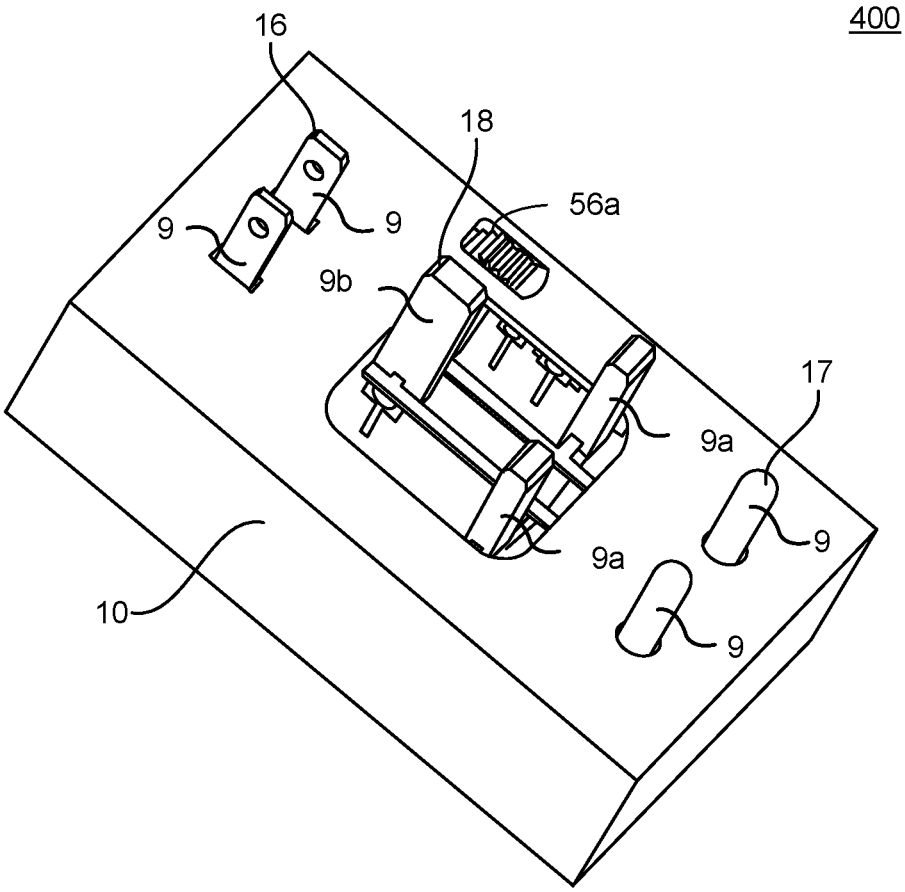
FIG. 15 is a perspective view of an electrical plug according to a seventh embodiment of the description, showing three prong sets in the deployed position, viewed from the top of the housing.

Referring to FIG. 15, an electrical plug 400 with multiple retractable prong sets is shown, according to a seventh embodiment of the description. As shown in FIG. 15, the electrical plug 400 includes three prong sets 16, 17, 18 accommodated in the same housing 10, where the Type A prong set 16, the Type C prong set 17, and the Type G prong set 18. According to this embodiment, all three prong sets 16, 17, 18 are retractable and can be arranged to be deployed from a same side of the housing 10. Each prong set 16, 17, 18 can be driven by a corresponding gear-based driving mechanism to move between the retracted position and the deployed position. From the view shown in FIG. 15, a driver 56*a* is shown for driving of the prong set 18 and is arranged to be accessed from a same side of the housing 10 from which the prongs 9*a*, 9*b* extend out of. In this embodiment, the driver 56*a* is a spur gear.

Figure 16:
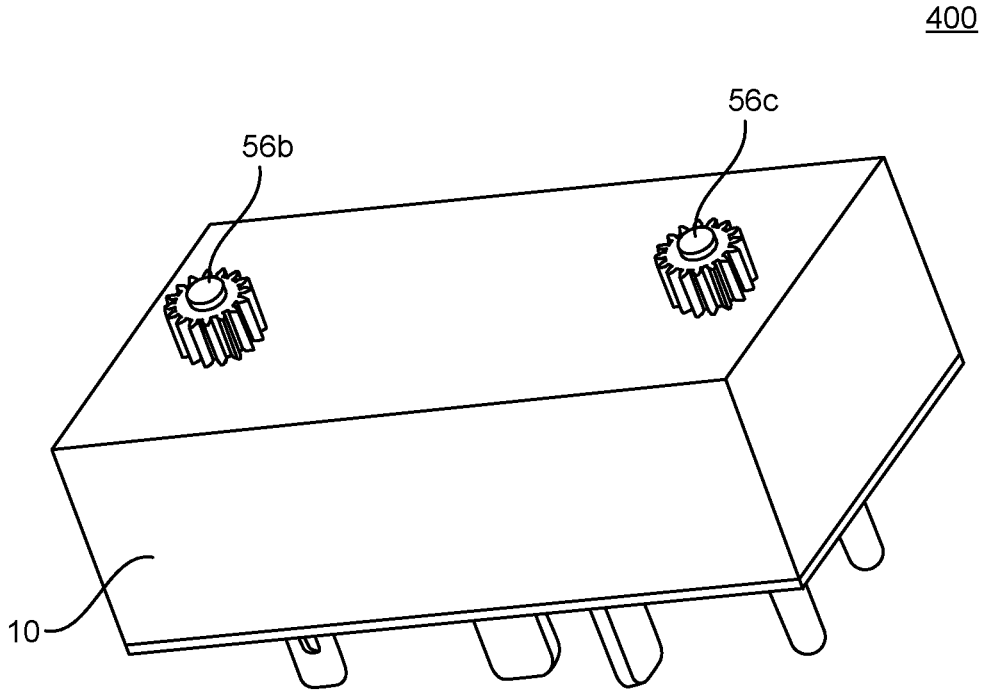
FIG. 16 is a perspective view of the electrical plug shown in FIG. 15, viewed from the bottom of the housing.

FIG. 16 shows the electrical plug 400 viewed from the bottom of the housing 10. As can be seen from FIG. 16, the electrical plug 400 further includes a driver gear 56*b* and a driver gear 56*c* for driving the prong set 16 and the prong set 17, respectively. In this embodiment, the driver gears 56*b* and 56*c* are both spur gears.

Figure 17:
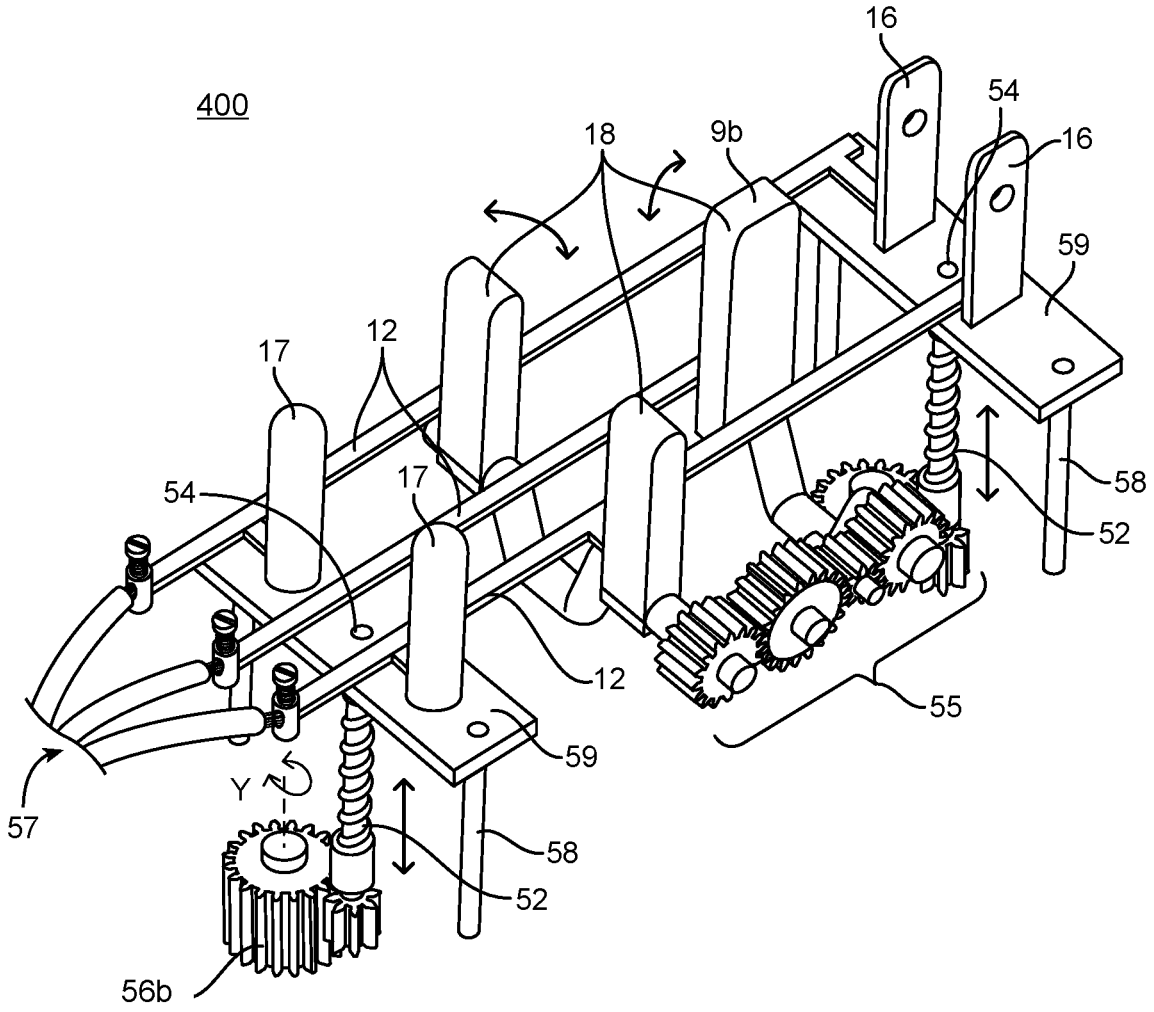
FIG. 17 is a perspective view of an internal structure of the electrical plug shown in FIG. 15, viewed from the top of the housing.
Figure 18:
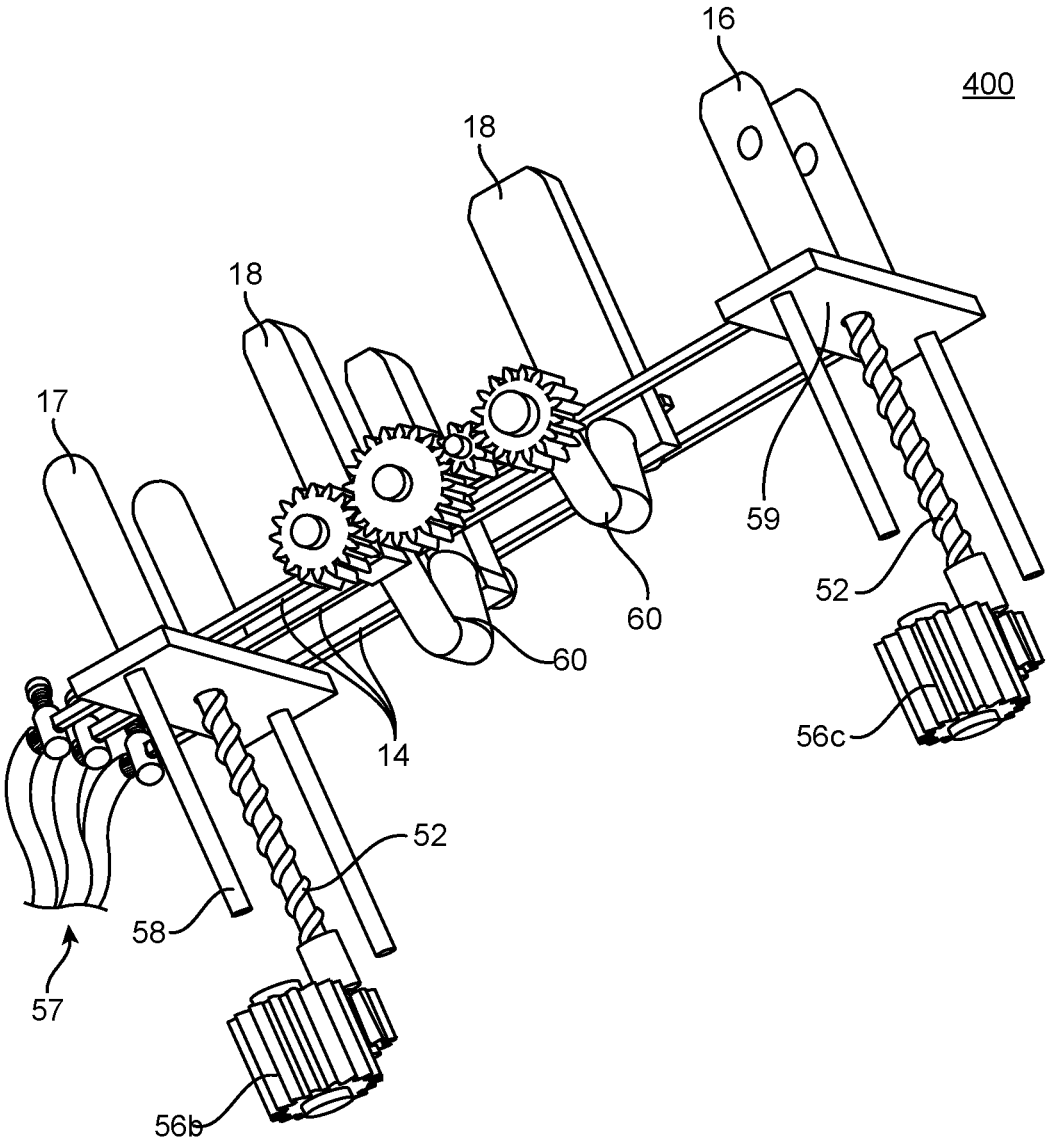
FIG. 18 is a perspective view of an internal structure of the electrical plug shown in FIG. 15, viewed from the bottom of the housing.

FIG. 17 is a perspective view of an internal structure of the electrical plug 400, viewed from the top of the housing 10. FIG. 18 is a perspective view of an internal structure of the electrical plug 400, viewed from the bottom of the housing 10.

The driving mechanism of the prong set 18 is similar to that described in relation to the fifth embodiment. According to this embodiment, each prong set 16, 17 is mounted on a corresponding platform 59 supported by supporting guides 58. The platform 59 can be moved vertically up or down, through a threaded hole 54 and a spiral shaft 52 functioning as a guided post. To effect movement of each prong set 16, 17, a driver 56*b*, 56*c* can be acted upon by the user to cause rotation of the corresponding spiral shaft 52. Depending on the direction of rotation of the driver 56*b*, 56*c*, the spiral shaft 52 can move the platform 59 vertically up or down thereby deploying or retracting the corresponding prong set 16, 17 mounted on the platform 59.

Busbars 12 are provided in the electrical plug 400 to enable correct connections for the prongs of each prong set 16, 17, 18 when they come into the deployed position. The prongs of the prong set 16, 17, 18 become disconnected from the busbars 12 when they move from the deployed position to the retracted position.

While this embodiment illustrates the multiple prong sets being deployable from the same side of the housing 10, it may be desirable to have multiple prong sets deployable from multiple sides of the housing 10, depending on the preferable dimensions of the electrical plug.

Figure 19:
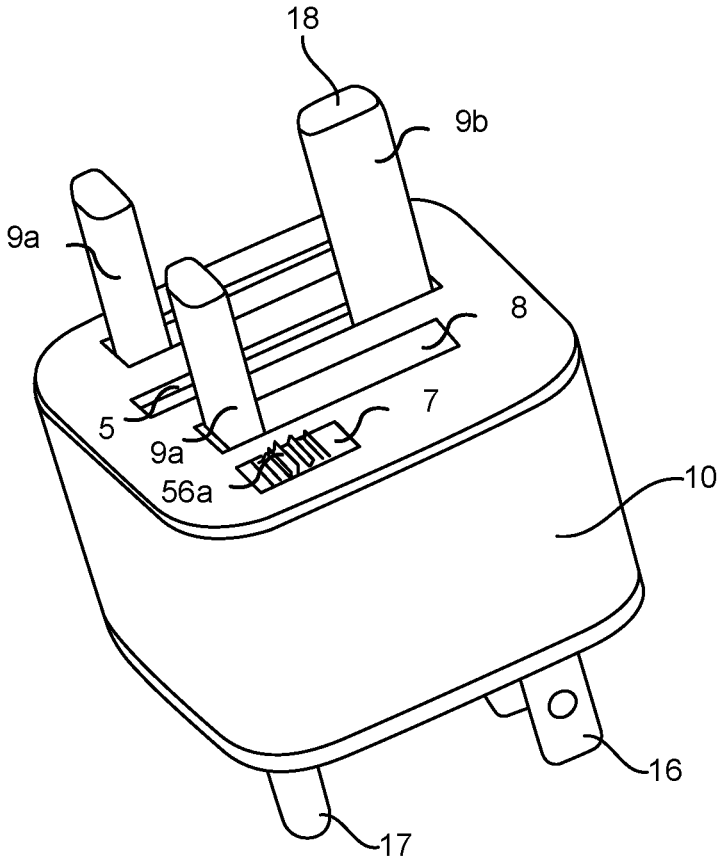
FIG. 19 is a perspective view of an electrical plug according to an eighth embodiment of the description, showing three prong sets in the deployed position, viewed from the top of the housing.
Figure 20:
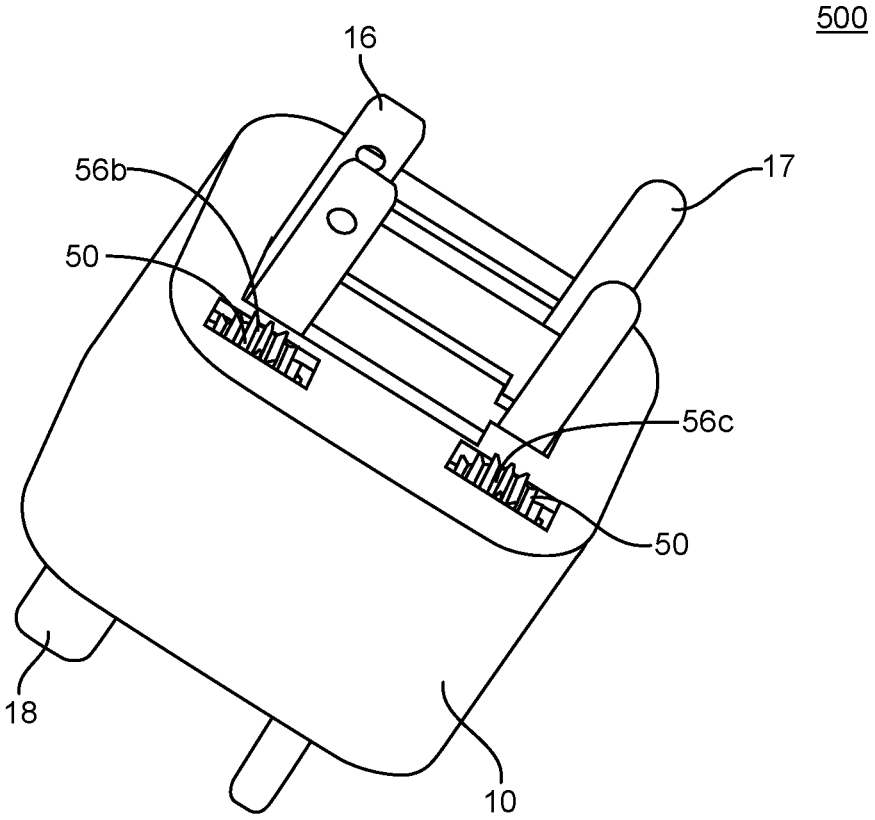
FIG. 20 is a perspective view of the electrical plug shown in FIG. 19, viewed from the bottom of the housing.

FIG. 19 is a perspective view of an electrical plug 500 according to an eighth embodiment of the description, viewed from the top of the housing 10. FIG. 20 is a perspective view of the electrical plug 500, viewed from the bottom of the housing 10.

As can be seen from FIGS. 19 and 20, the electrical plug 500 also includes three prong sets 16, 17, 18 accommodated in the same housing 10. Different from the seventh embodiment, the Type G prong set 18 is deployable from one side of the housing 10, whilst the Type C prong set 17 and Type A prong set 16 are deployable from an opposite side of the housing 10. Three drivers 56*a*, 56*b*, 56*c* are provided for driving the prong sets 18, 16, 17 respectively. In this embodiment, each driver 56*a*, 56*b*, 56*c* is a spur gear and arranged to be accessible from a same side of the housing 10 from which its corresponding prong set 18, 16, 17 extend out of.

Figure 21:
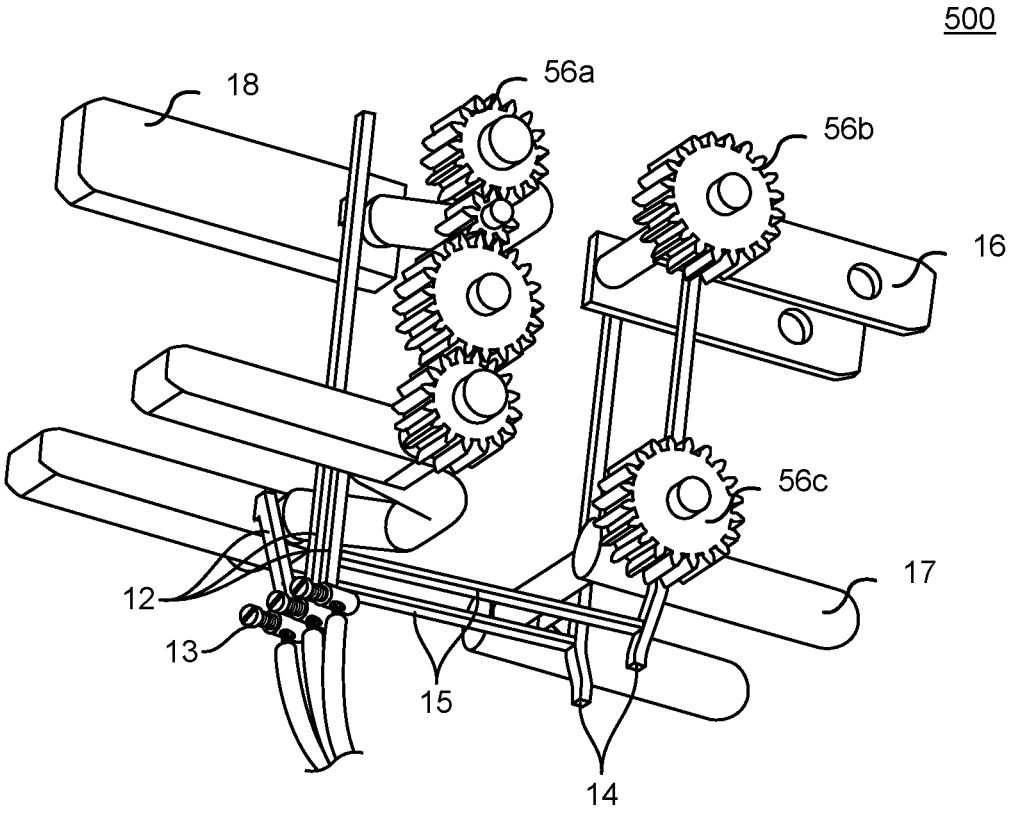
FIG. 21 is a perspective view of an internal structure of the electrical plug shown in FIG. 19.
Figure 22:
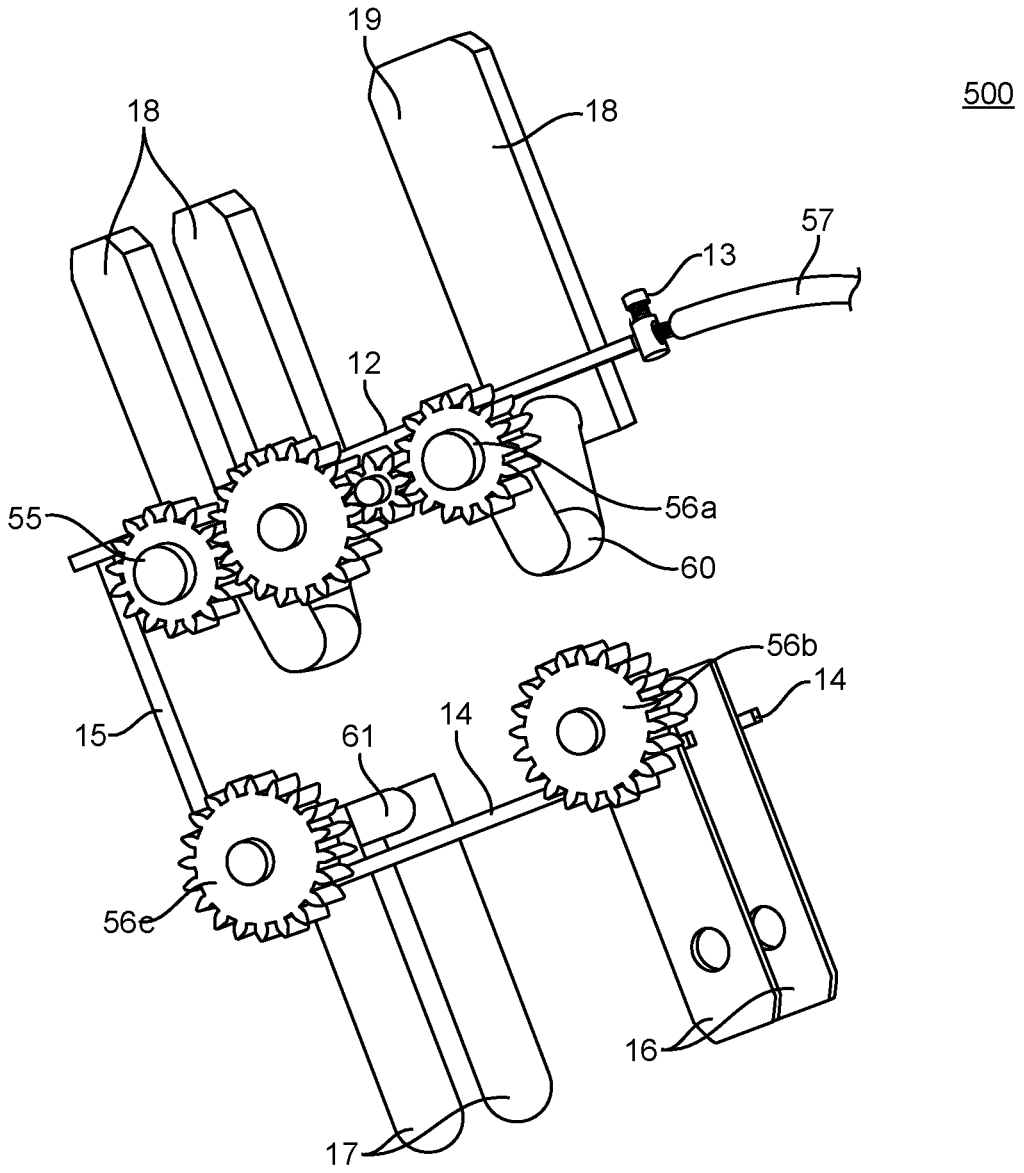
FIG. 22 is a side view of the internal structure of the electrical plug shown in FIG. 21.

FIG. 21 is a perspective view of an internal structure of the electrical plug 500. FIG. 22 is a side view of the internal structure. The driving mechanisms of the Type A, C, G prong sets 16, 17, 18 are similar to those described above. According to this embodiment, because prong sets are configured on multiple sides of the housing 10, a secondary set of busbars 14 can be used to supply the prong sets 16, 17 from an opposite of the housing 10. The prong sets 16, 17, 18 can be powered from a same external source or from different external sources. In the case of powering the three prong sets 16, 17, 18 from a same external source, the secondary busbars 14 can be connected to the primary busbars 12 through connecting busbars 15. Alternatively, it would be possible to supply the prong sets 16, 17, 18 on different sides from different external sources by providing a connecting mechanism (not shown), such as barrel plugs 13, to the secondary busbars 14. As the electrical plug according to the embodiment enables powering of different prong sets from different external sources, the electrical plug can be provided without any cable and used as a conduit. The electrical plug can connect to different sources when necessary, adding versatility to its use.

Figure 23:
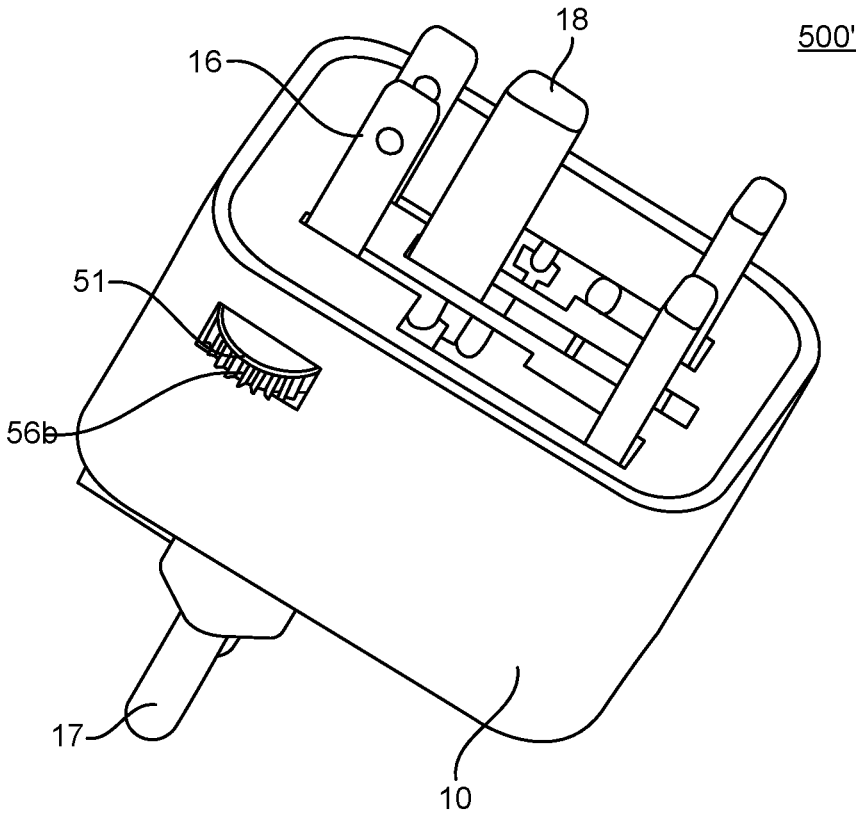
FIG. 23 is a perspective view of an electrical plug according to a ninth embodiment of the description, showing three prong sets in the deployed position, viewed from the top of the housing.
Figure 24:
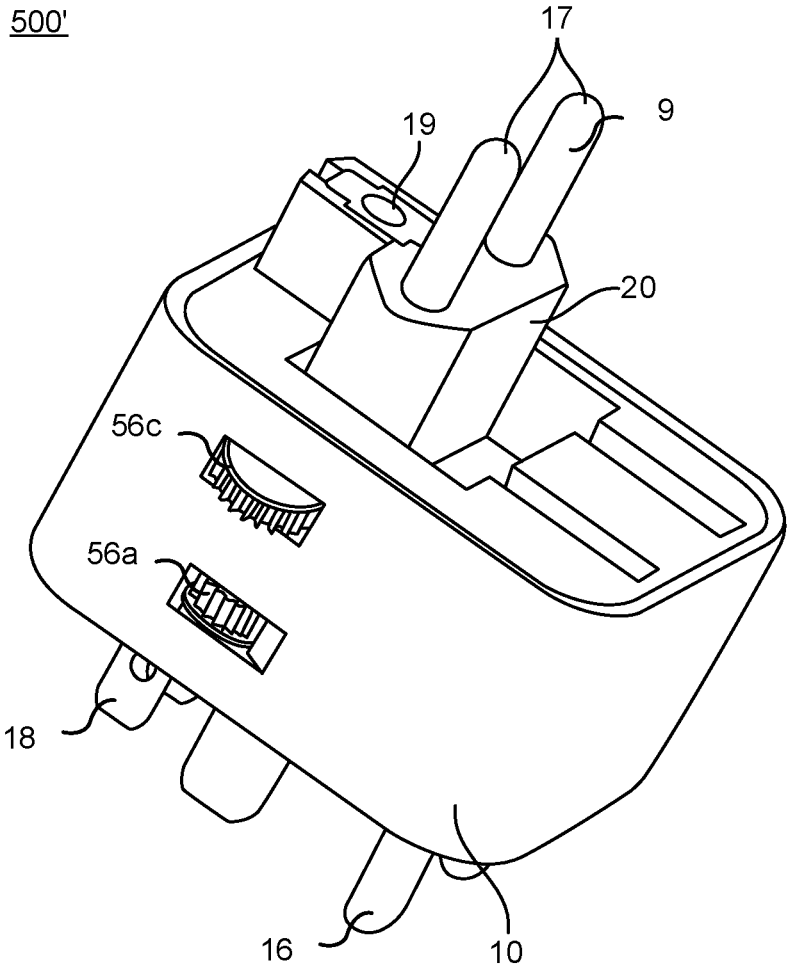
FIG. 24 is a perspective view of the electrical plug shown in FIG. 23, viewed from the bottom of the housing.
Figure 25:
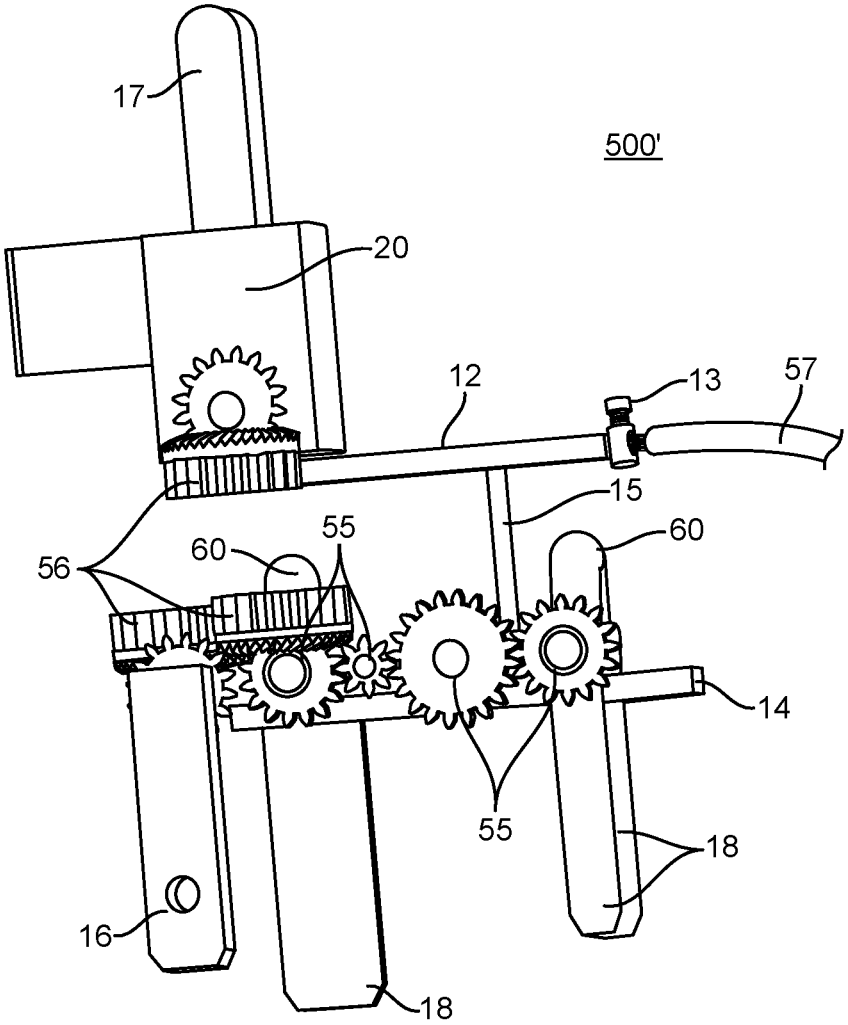
FIG. 25 is a side view of an internal structure of the electrical plug shown in FIG. 23.
Figure 26:
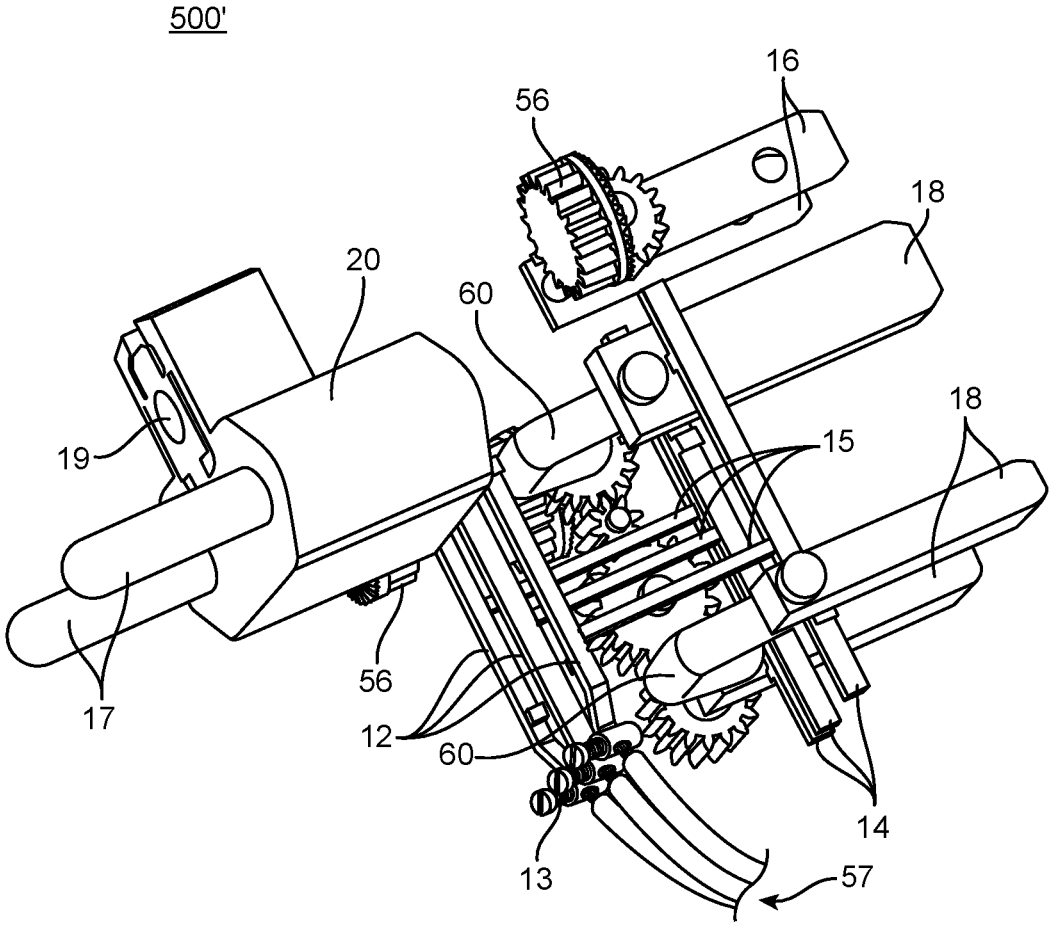

FIG. 23 is a perspective view of an electrical plug 500' according to a ninth embodiment of the description, viewed from the top of the housing 10. FIG. 24 is a perspective view of the electrical plug 500', viewed from the bottom of the housing 10.

In this embodiment, the Type G prong set 18 and the Type A prong set 16 are deployable from one side of the housing 10, whilst a Type E prong set 17 is deployable from an opposite side of the housing 10. Compared to the Type C prong set 17 discussed above, the prong assembly 20 of the Type E prong set further includes an additional female receptacle 19 for mating with an earth prong protruding from a compatible Type E socket. The Type E prong set is configured according to the IEC Type E standard used in the EU.

The electrical plug 500' includes three drivers 56*a*, 56*b*, 56*c* for driving the prong sets 18, 16, 17 respectively. Similar to the third and fourth embodiments, each driver 56*a*, 56*b*, 56*c* in this embodiment can be a bevel gear and arranged to be accessed from a side of the housing 10 different from which its corresponding prong set 18, 16, 17 extend out of.

According to various embodiments described above, when the prongs are in the deployed position, the prongs are connected to the external power source(s) through busbars. The base of each prong can be modified to provide an improved mating mechanism between the prong and the busbar(s). There are many factors that may be considered for configuring the electrical connections between the prongs and the busbars, including for example, space constraints, axial positions, and/or robust performance.

A number of mating mechanisms are provided in this description to improve electrical connections between the prongs and the busbars. Although it is possible to engage the busbars with prongs without any modification, the following modified prongs can allow for more secure connections with the busbars, and allow flexibility in arrangement. When the prong set comes into the deployed position, the mating mechanism allows for an effective connection for the prongs. When the prong set moves from the deployed position to the retracted position, the prongs of the prong set become disconnected from any electricity supply.

Figure 27:
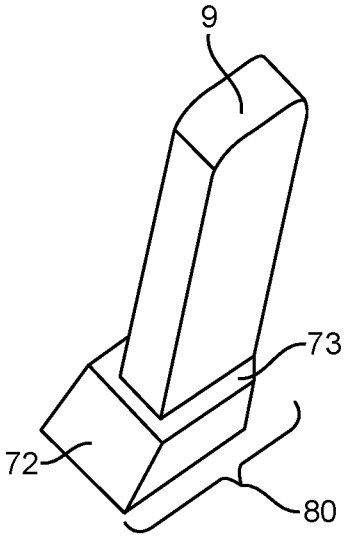
FIG. 27 is a perspective view of a prong with a modified base, according to an embodiment of the disclosure.
Figure 28:
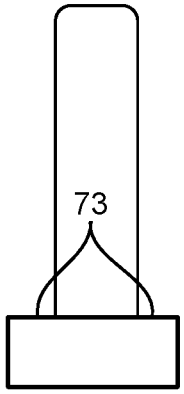
FIG. 28 is a front plan view of the prong shown in FIG. 27.
Figure 29:
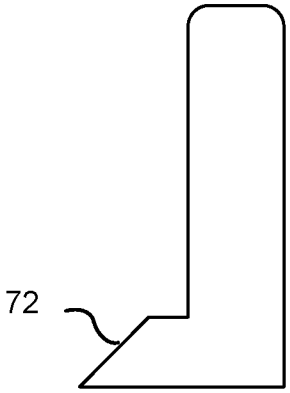
FIG. 29 is a side plan view of the prong shown in FIG. 27.

FIG. 27 shows a prong 9 with a base 80 of the prong being modified to have a tapered surface 72, according to an embodiment of the description. The base 80 of the prong 9 is also enlarged leaving space on sides 73 of the base for electrical contact with the busbar(s). FIG. 28 provides a front plan view of the prong 9 shown in FIG. 27 and FIG. 29 illustrates a corresponding side plan view.

Figure 30:
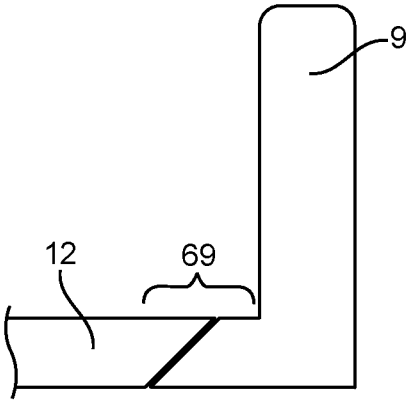
FIG. 30 is a side plan view of the prong shown in FIG. 27, mating with a busbar, according to an embodiment of the disclosure.

FIG. 30 illustrates an example of a mating mechanism 69, in which the prong 9 shown in FIG. 27 when deployed is mated with a busbar 12 having a corresponding taped surface complementing the tapered surface 72. Such an angled mating mechanism creates an enlarged connection surface and can achieve a more effective connection. It also restricts further rotation of the prong(s) in a given direction. Examples of the angled mating mechanism are shown in FIGS. 2, 6, and 14.

Figure 31:
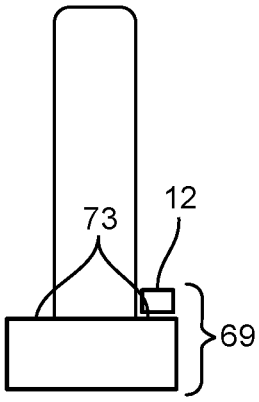
FIG. 31 is a front plan view of the prong shown in FIG. 27, where the busbar is mated with a side of the base of the prong, according to another embodiment of the disclosure.
Figure 32:
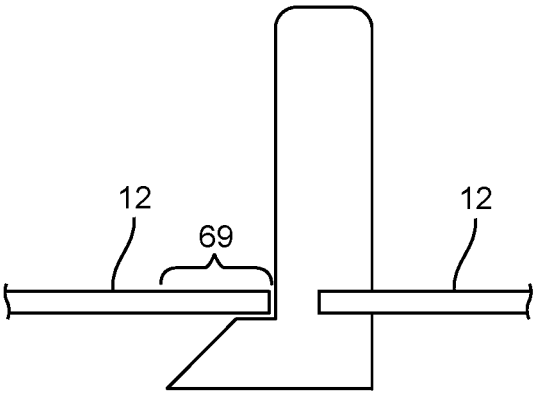
FIG. 32 is a side plan view of the mating mechanism shown in FIG. 27.

Also, the mating mechanism 69 can allow for side contact with the busbar 12 where two flat surfaces of the conductors 12 and 80 come into contact with one another. FIG. 31 is another example of the mating mechanism 69, where the busbar 12 is mated with the side 73 of the modified base 80 of the prong 9. FIG. 32 illustrates its corresponding side plan view.

Figure 33:
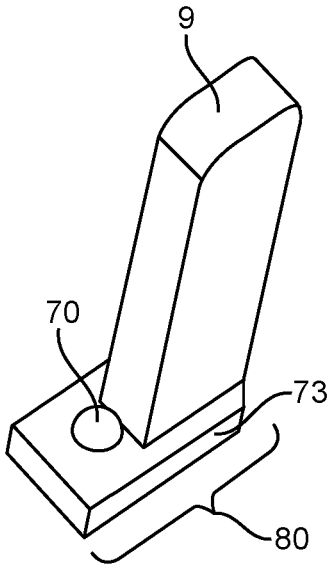
FIG. 33 is a perspective view of a prong with a modified base, according to an embodiment of the disclosure.
Figure 34:
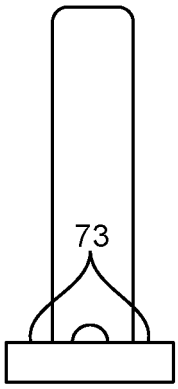
FIG. 34 is a front plan view of the prong shown in FIG. 33.

FIG. 33 shows a prong 9 with a base 80 of the prong 9 being modified to have a conductive protrusion 70, according to an embodiment of the description. The base 80 of the prong 9 is also enlarged leaving space on sides 73 of the base for contacts with the busbar(s). FIG. 33 provides a front plan view of the prong 9 shown in FIG. 33 and FIG. 34 illustrates a corresponding side plan view.

Figure 35:
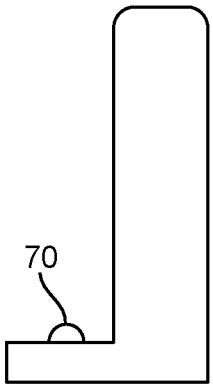
FIG. 35 is a side plan view of the prong shown in FIG. 33.
Figure 36:
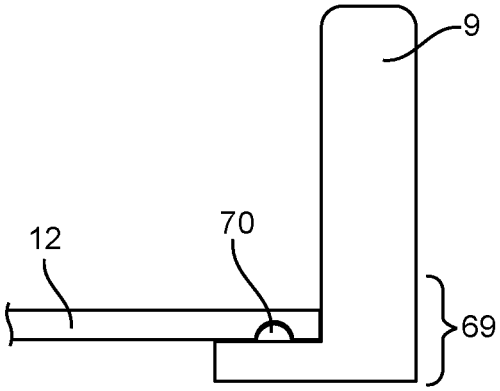
FIG. 36 is a side plan view of the prong shown in FIG. 33, mating with a busbar, according to an embodiment of the disclosure.

FIG. 35 illustrates an example of a mating mechanism 69 in which the prong 9 shown in FIG. 33 when deployed is mated with a busbar 12 having a corresponding recessed surface complementing the protrusion 70. Such a distended mating mechanism allows for a strong bond between the two conductors 12 and 80.

Figure 37:
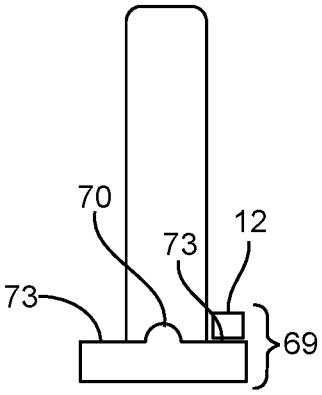
FIG. 37 is a front plan view of the prong shown in FIG. 33, where the busbar is mated with a side of the base of the prong, according to another embodiment of the disclosure.
Figure 38:
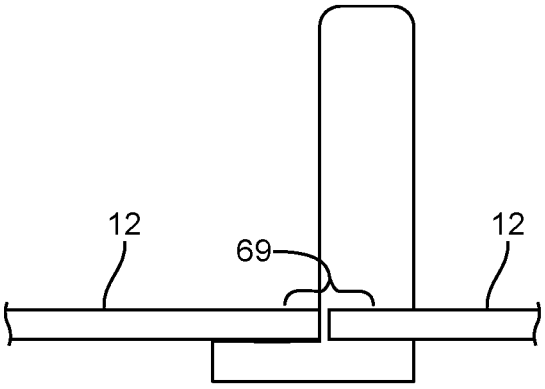
FIG. 38 is a side plan view of the mating mechanism shown in FIG. 37.

Also, the mating mechanism 69 can allow for side contact with the busbar 12 where two flat surfaces of the conductors 12 and 80 come into contact with one another. FIG. 37 is another example of the mating mechanism 69, where the busbar 12 is mated with the side 73 of the modified base 80 of the prong 9. FIG. 38 illustrates its corresponding side plan view.

Figure 39:
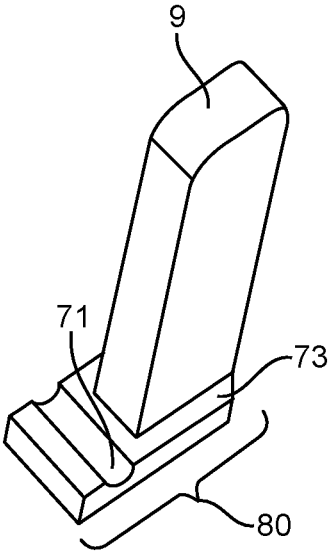
FIG. 39 is a perspective view of a prong with a modified base, according to an embodiment of the disclosure.
Figure 40:
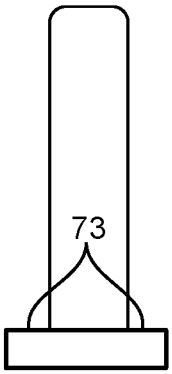
FIG. 40 is a front plan view of the prong shown in FIG. 39.
Figure 41:
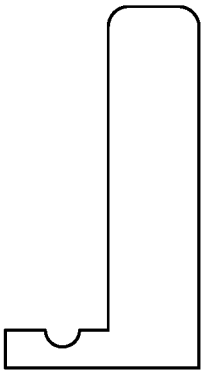
FIG. 41 is a side plan view of the prong shown in FIG. 39.

FIG. 39 shows a prong 9 with a base 80 of the prong 9 being modified to have a recess 71, according to an embodiment of the description. The base 80 of the prong 9 is also enlarged leaving space on sides 73 of the base for contacts with the busbar(s). FIG. 40 provides a front plan view of the prong 9 shown in FIG. 39 and FIG. 41 illustrates a corresponding side plan view.

Figure 42:
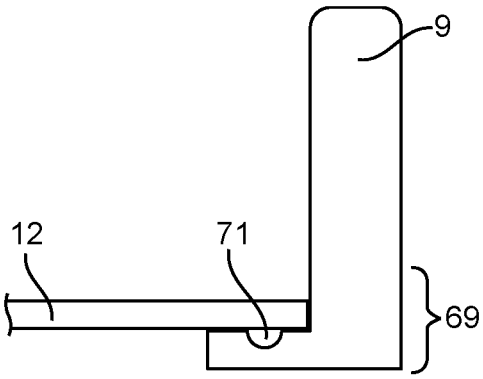
FIG. 42 is a side plan view of the prong shown in FIG. 39, mating with a busbar, according to an embodiment of the disclosure.

FIG. 42 illustrates an example of a mating mechanism 69 in which the prong 9 shown in FIG. 39 when deployed is mated with a busbar 12 having a corresponding protrusion complementing the recess 71. Such a recessed mating mechanism is similar to a handshake or a clasp, which allows for multiple faces of contact between the two conductors 12 and 80.

Figure 43:
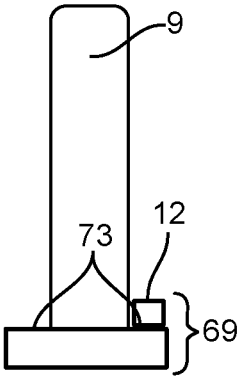
FIG. 43 is a front plan view of the prong shown in FIG. 39, where the bus bar is mated with a side of the base of the prong, according to another embodiment of the disclosure.
Figure 44:
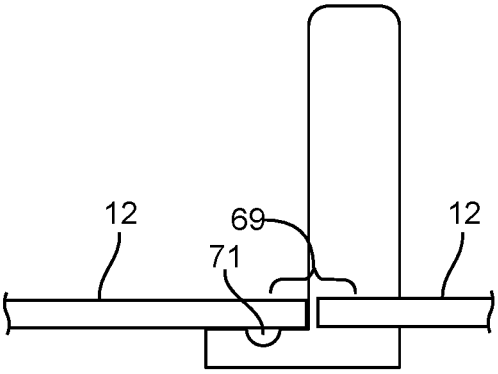
FIG. 44 is a side view of the mating mechanism shown in FIG. 39.

Also, the mating mechanism 69 can allow for side contact with the busbar 12 where two flat surfaces of the conductors 12 and 80 come in contact with another. FIG. 43 is another example of the mating mechanism 69, where the busbar 12 is mated with the side 73 of the modified base 80 of the prong 9. FIG. 44 illustrates its corresponding side plan view.

Since the modified base 80 of the prong 9 as described above can be accessible from the side 73, it is possible to have the mating mechanism arranged from one of the four sides 73 of the modified base 80.

Figure 46:
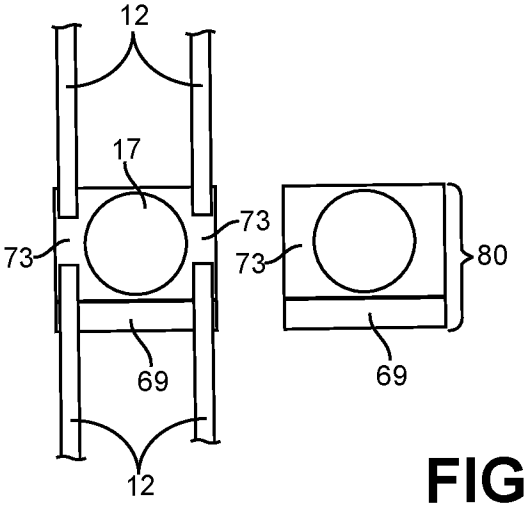
FIG. 46 is a top plan view of a Type C prong and a mating mechanism between one prong and busbars, according to an embodiment of the disclosure.
Figure 47:
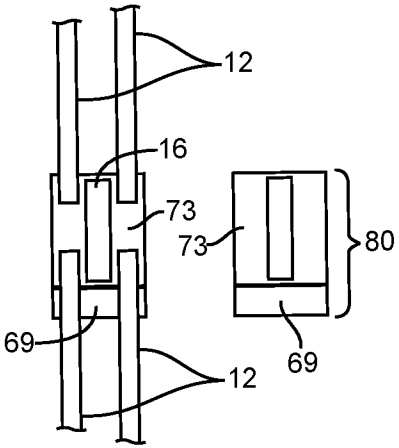
FIG. 47 is a top plan view of a Type A prong set and a mating mechanism between one prong and busbars, according to an embodiment of the disclosure.
Figure 45:
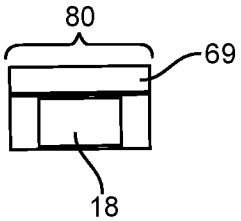
FIG. 45 is a top plan view of a Type G prong set and a mating mechanism between one prong and busbars, according to an embodiment of the disclosure.
Figure 45:
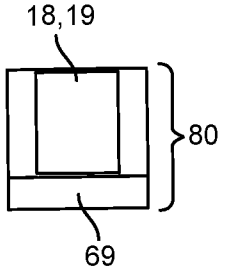
Figure 45:
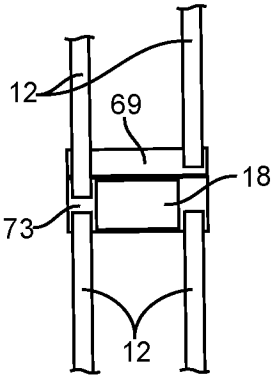

FIGS. 45, 46 and 47 illustrate the side mating mechanism applying to the Type G prong set 18, Type C prong set 17, and Type A prong set 16, respectively, according to an embodiment of the description. As illustrated in FIGS. 45, 46 and 47, the busbar 12 can be electrically connected to any side 73 of the modified base 80. The busbar 12 connection is only shown with respect to the left side prong in each of the prong set 16, 17, 18, but omitted with respect to the other prong(s) for simplicity. Also in this embodiment, it is noted that for each modified base 80, the base 80 is enlarged with respect to three of the four sides 73. This is to reduce the height dimension when the prongs are retracted. An example of a side mating mechanism is also shown in FIG. 10 in relation to the Type G prong set 18.

While the above embodiments are illustrated in the form of an electrical plug, the described structure can also be applied to a power adapter.

Figure 48:
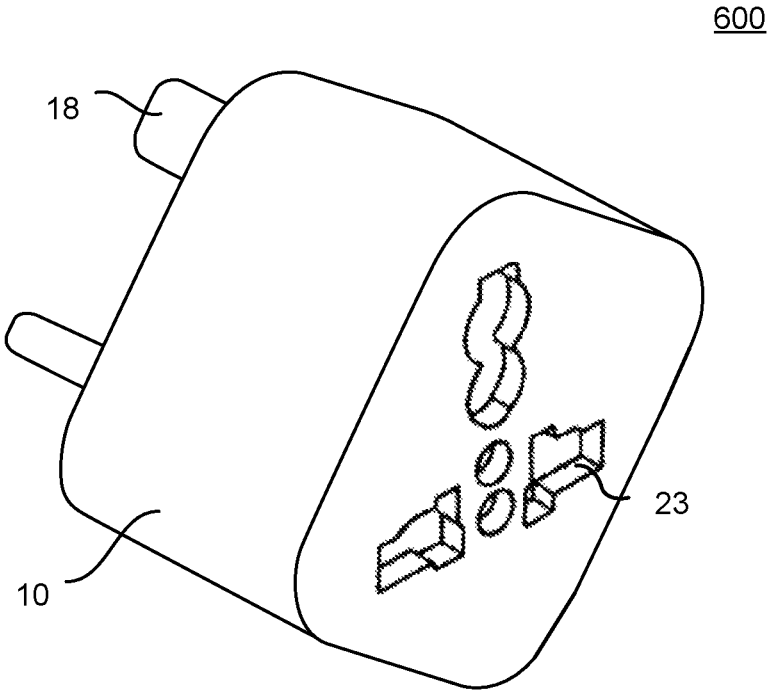
FIG. 48 is a perspective view of an electrical adapter, viewed from the bottom of the housing, according to an embodiment of the disclosure.

FIG. 48 illustrates a perspective view of a power adapter 600, according to an embodiment of the disclosure. Similar to the above described embodiments, the power adapter 600 can include at least one set 18 of retractable prongs simultaneously rotatable between a retracted position in which the prongs are positioned within the housing and a deployed position in which the prongs extend out of the housing to be inserted into an electrical outlet.

The power adapter 600 further includes at least one gear-based driving mechanism coupled to a corresponding retractable prong set 18 for driving the simultaneous rotation of the prongs of the prong set, as described above. The gear-based driving mechanism includes a driver (not shown in this view) which can be accessed from the housing for actuation of the gear-based driving mechanism. As shown in FIG. 48, one side of the housing 10 can include a plurality of receptacles 23 for receiving compatible prongs (not shown). While in this embodiment, the adapter includes a Type G retractable prong set 18, it should be understood that retractable prong set(s) of other type(s) can be used instead or in addition to the Type G prong set, and may be arranged on different side(s) of the housing, as described above. The prongs can be mounted to a shaft, or as part of a prong assembly.

The gear-based driving mechanism as described in the embodiments of the description allows for the retraction and deployment of a spatially displaced multi-prong set. The prong set can rotate in and out of a plane, or move vertically in the same plane. A driver can be acted upon to effect the simultaneous movement or rotation of all prongs in the same prong set. The driver can be arranged on the same, adjacent, or opposite planes from which the corresponding prongs extend out of.

By moving all the prongs of a prong set simultaneously through manipulation of the driver, the prong set can be easily deployed for use without any direct contact from the hands of the user with the prongs. Various embodiments can also provide compact and versatile power plugs with multi-country functionality where prong sets of different types can be accommodated and deployed using a single housing.

While various embodiments illustrate the use of the gear drivetrain 55 to rotate two shafts simultaneously, it should be apparent that the gear drivetrain 55 can be easily modified to drive more than two shafts or prong assemblies simultaneously. As well, the gear-based driving mechanism can be modified to drive prong set(s) of other types with more than two parallel arranged prongs (e.g., IEC standard Types B, D, F, H through O, and/or US standard SRDT, NEMA 5, 6, 7, 10, 11, 14, 15, 18 Types).

As well, while busbars and barrel clamps are used for the purpose of the electrical connection, it should be understood that other arrangements, such as other types of wire arrangements, U-clamps, soldering, cable lugs, and/or other bolt-on or screw arrangement may also be used in addition or instead of the busbars and barrel clamps described.

While several embodiments have been provided in the present disclosure, it should be understood that the disclosed systems and methods might be embodied in many other specific forms without departing from the scope of the present disclosure. The present examples are to be considered as illustrative and not restrictive, and the intention is not to be limited to the details given herein. For example, the various elements or components may be combined or integrated in another system or certain features may be omitted, or not implemented.

What is claimed is:

1. An electrical plug comprising:

a housing;

a retractable prong set including a plurality of prongs, the plurality of prongs being rotatable simultaneously between a retracted position in which the plurality of prongs are positioned within the housing and a deployed position in which the plurality of prongs extend out of the housing to be inserted into an electrical outlet; and a gear-based driving mechanism coupled to the retractable prong set for driving the plurality of prongs to simultaneously rotate between the retracted position and the deployed position, wherein the gear-based driving mechanism comprises two or more gears coupled to each other for driving the plurality of prongs simultaneously, and includes a driver accessible from the housing for actuation of the gear-based driving mechanism, such that when the driver is acted upon by a user it causes the gear-based driving mechanism to move the retractable prong set between the retracted and deployed positions.

2. The electrical plug according to claim 1, wherein the plurality of prongs are rotatable with respect to a first axis, and the driver is arranged to be rotatable with respect to the first axis.

3. The electrical plug according to claim 1, wherein the plurality of prongs are rotatable with respect to a first axis, and the driver is arranged to be rotatable with respect to a second axis perpendicular to the first axis.

4. The electrical plug according to claim 1, wherein the gear-based driving mechanism comprises a series of gears coupled to each other for driving the plurality of prongs simultaneously.

5. The electrical plug according to claim 1, wherein the plurality of prongs are coupled to the gear-based driving mechanism through at least one elbow shaft.

6. The electrical plug according to claim 1, further comprising a plurality of retractable prong sets, each retractable prong set including a plurality of prongs movable simultaneously between a retracted position in which the corresponding prongs are positioned within the housing and a deployed position in which the corresponding prongs extend out of the housing to be inserted into an electrical outlet; and wherein the gear-based driving mechanism includes a plurality of drivers accessible from the housing, each driver coupled to the corresponding retractable prong set for driving the prongs simultaneously between the retracted position and the deployed position.

7. The electrical plug according to claim 6, wherein the multiple retractable prong sets are arranged to be deployed from a same side of the housing.

8. The electrical plug according to claim 6, wherein the multiple retractable prong sets are arranged to be deployed from at least two sides of the housing.

9. The electrical plug according to claim 1, further comprising a prong assembly for housing at least two prongs of the prong set.

10. The electrical plug according to claim 9, wherein the prong assembly includes a female receptacle for mating with a compatible protrusion from a corresponding socket.

11. The electrical plug according to claim 1, further comprising at least one busbar for electrically connecting the prong set to an external power source when in the deployed position, the plurality of prongs being electrically disconnected from the at least one busbar when not in the deployed position.

12. The electrical plug according to claim 11, wherein a base of the prong has a tapered surface for mating with the busbar.

13. The electrical plug according to claim 11, wherein a base of the prong has a protrusion for mating with the busbar.

14. The electrical plug according to claim 11, wherein a base of the prong has a recess for mating with the busbar.

15. The electrical plug according to claim 11, wherein the prong has an enlarged base and the busbar is electrically connected to a side of the base of the prong when in the deployed position.

16. An electrical plug comprising:

a housing;

a first retractable prong set including a first plurality of prongs, the first plurality of prongs being rotatable simultaneously between a retracted position in which the first plurality of prongs are positioned within the housing and a deployed position in which the first plurality of prongs extend out of the housing to be inserted into a first electrical outlet;

a second retractable prong set including a second plurality of prongs, the second plurality of prongs being movable simultaneously between a retracted position in which the second plurality of prongs are positioned within the housing and a deployed position in which the second plurality of prongs extend out of the housing to be inserted into a second electrical outlet;

a first gear-based driving mechanism coupled to the first retractable prong set for driving the first plurality of prongs to simultaneously rotate between the retracted position and the deployed position, wherein the first gear-based driving mechanism includes a first driver accessible from the housing for actuation of the first gear-based driving mechanism, and a second gear-based driving mechanism coupled to the second retractable prong set for driving the second plurality of prongs to simultaneously move between the retracted position and the deployed position, wherein the second gear-based driving mechanism includes a second driver accessible from the housing for actuation of the second gear-based driving mechanism.

17. An electrical plug comprising:

a housing;

a plurality of retractable prong sets, each retractable prong set including a plurality of prongs rotatable simultaneously between a retracted position in which the corresponding prongs are positioned within the housing and a deployed position in which the corresponding prongs extend out of the housing to be inserted into an electrical outlet; and a plurality of gear-based driving mechanisms corresponding to the plurality of retractable prong sets, each gear-based driving mechanism coupled to the corresponding retractable prong set for driving the plurality of prongs of the corresponding retractable prong set simultaneously between the retracted position and the deployed position, wherein each gear-based driving mechanism includes a driver accessible from the housing for actuation of the corresponding gear-based driving mechanism.

18. The electrical plug according to claim 17, further comprising a plurality of busbars for electrically connecting the plurality of prong sets to a same external power source when in the deployed position, each prong set being electrically disconnected from the plurality of busbars when not in the deployed position.

19. The electrical plug according to claim 17, further comprising a plurality of busbars for electrically connecting the plurality of prong sets to different external power sources when in the deployed position, each prong set being electrically disconnected from the plurality of busbars when not in the deployed position.

20. The electrical plug according to claim 17, wherein the prong has an enlarged base and the plug further comprises a plurality of busbars, at least one of the busbars being electrically connected to a side of the base of the prong when in the deployed position, each prong set being electrically disconnected from the plurality of busbars when not in the deployed position.

21. An electrical adapter comprising:

a housing;

a retractable prong set including a plurality of prongs, the plurality of prongs being rotatable simultaneously between a retracted position in which the plurality of prongs are positioned within the housing and a deployed position in which the plurality of prongs extend out of the housing to be inserted into an electrical outlet;

a gear-based driving mechanism coupled to the retractable prong set for driving the plurality of prongs to simultaneously rotate between the retracted position and the deployed position, wherein the gear-based driving mechanism comprises two or more gears coupled to each other for driving the plurality of prongs simultaneously, and includes a driver accessible from the housing for actuation of the gear-based driving mechanism, such that when the driver is acted upon by a user it causes the gear-based driving mechanism to move the retractable prong set between the retracted and deployed positions; and a plurality of receptacles for receiving compatible external prongs.

22. The electrical adapter according to claim 21, further comprising a plurality of retractable prong sets, each retractable prong set including a plurality of prongs movable simultaneously between a retracted position in which the corresponding prongs are positioned within the housing and a deployed position in which the corresponding prongs extend out of the housing to be inserted into an electrical outlet; and wherein the gear-based driving mechanism includes a plurality of drivers accessible from the housing, each driver coupled to the corresponding retractable prong set for driving the prongs simultaneously between the retracted position and the deployed position.

23. The electrical adapter according to claim 21, further comprising a prong assembly for housing at least two prongs of the prong set.

* * * * *